US005415983A

United States Patent [19]

Kojima et al.

[11] Patent Number: 5,415,983

[45] Date of Patent: * May 16, 1995

[54] METHOD FOR PROCESSING A SILVER HALIDE PHOTOGRAPHIC MATERIAL

[75] Inventors: Tetsuro Kojima; Nobuo Watanabe, both of Minami Ashigara, Japan

[73] Assignee: Fuji Photo Film Co., Ltd., Kanagawa, Japan

[ * ] Notice: The portion of the term of this patent subsequent to Mar. 28, 2012 has been disclaimed.

[21] Appl. No.: 97,912

[22] Filed: Jul. 28, 1993

Related U.S. Application Data

[63] Continuation of Ser. No. 5,169, Jan. 15, 1993, abandoned, which is a continuation of Ser. No. 622,054, Dec. 4, 1990, abandoned.

[30] Foreign Application Priority Data

Dec. 4, 1989 [JP] Japan ..... 1-314974
Aug. 3, 1990 [JP] Japan ..... 2-206069

[51] Int. Cl.[6] ..... G03C 5/38

[52] U.S. Cl. ..... 430/455; 430/393; 430/459; 430/460

[58] Field of Search ..... 430/393, 430, 455, 459, 430/460, 461

[56] References Cited

U.S. PATENT DOCUMENTS

| | | | |
|---|---|---|---|
| H953 | 8/1991 | Goto et al. | 430/455 |
| 4,003,910 | 1/1977 | Bartels-Keith et al. | 548/110 |
| 4,378,424 | 3/1983 | Altland et al. | 430/352 |
| 4,939,075 | 7/1990 | Bergthaller et al. | 430/460 |
| 4,939,075 | 7/1990 | Bergthaller et al. | 430/460 |

FOREIGN PATENT DOCUMENTS

| | | |
|---|---|---|
| 0054415 | 6/1982 | European Pat. Off. . |
| 0321839 | 6/1989 | European Pat. Off. . |
| 62-253161 | 11/1987 | Japan . |
| 1201659 | 8/1989 | Japan . |
| 244355 | 2/1990 | Japan . |
| 2139547 | 5/1990 | Japan . |

OTHER PUBLICATIONS

Tetrahedron Letters No. 56, pp. 5881–5884, 1968.
Tetrahedron Letters No. 19, pp. 1809–1814, 1967.
Berichte der Deutschen Chemischen Gesellschaft, vol. 38, p. 4049 (1905).
J. Chem. Soc., Perkin I, p. 624 (1974).
J. Heterocyclic Chem., vol. 2, p. 105 (1965).
J. Heterocyclic Chem., vol. 5, p. 277 (1968).
J. Chem. Soc., p. 2865 (1959).
Advances in Heterocyclic Chemistry, vol. 19, (1976).
Tetrahedron Letters, pp. 1577–1578 (1971).
J. Org. Chem., vol. 30, p. 567 (1965).
J. Chem. Soc. Commun., pp. 1222 & 1224 (1971).

*Primary Examiner*—Hoa Van Le
*Attorney, Agent, or Firm*—Sughrue, Mion, Zinn, Macpeak & Seas

[57] ABSTRACT

A method for processing a silver halide photographic material is disclosed, comprising a support having thereon at least one light-sensitive silver halide emulsion layer, which comprises the steps of developing and fixing the image-wise exposed silver halide photographic material, wherein the fixing bath used in the fixing step contains at least one meso-ionic compound other than meso-ionic 1,2,4-triazolium-3-thiolate compounds, wherein said meso-ionic compound is a compound represented by formula (I):

(I)

wherein M and A$\theta$ are as defined in the specification as a fixing agent. The fixing bath and subsequent baths have excellent stability against precipitation, and the processed photographic material having improved image stability can be obtained.

7 Claims, No Drawings

METHOD FOR PROCESSING A SILVER HALIDE PHOTOGRAPHIC MATERIAL

This is a Continuation of application No. 08/005,169 field Jan. 15, 1993, abandoned which is a Continuation of application No. 07/622,054 filed Dec. 4, 1990, abandoned.

FIELD OF THE INVENTION

This invention relates to a method for processing a silver halide light-sensitive material and, more particularly, to a method for processing a silver halide photographic material in which a fixing bath and subsequent baths have excellent stability and which prevents thermostain of a processed silver halide photographic material.

BACKGROUND OF THE INVENTION

Photographic processing of silver halide color photographic materials generally consists of color development and desilvering. In desilvering, reduced silver resulting from development is oxidized with a bleaching agent and then dissolved with a fixing agent. Bleaching agents mainly include ferric ion complexes (e.g., aminopolycarboxylic acid-iron (III) complex salt), and fixing agents mainly include thiosulfates.

Photographic processing of black-and-white light-sensitive materials consists of development and removal of unexposed silver halide. Unlike the processing of color photographic materials, the black-and-white photographic materials are subjected to fixing without bleaching. In this case, too, thiosulfates are usually used as a fixing agent.

With the recent tendency toward reduction of replenishment, it has been demanded that each processing bath has improved stability. With respect to a fixing bath, since commonly employed thiosulfates undergo oxidative deterioration to form a precipitate of a sulfide, a sulfite is added as a preservative for prevention of oxidation in most cases. As a rate of replenishment is further reduced, a further improvement in fixing bath stability is demanded. However, the demand can be no more met by a mere addition of an increased amount of a sulfite preservative because of a limit of solubility and undesired precipitation of Glauber's salt accompanying oxidation of the sulfite.

U.S. Pat. No. 4,378,424 and JP-A-57-150842 (the term "JP-A" as used herein means an "unexamined published Japanese patent application") propose to use meso-ionic 1,2,4-triazolium-3-thiolate compounds as a fixing agent taking the place of thiosulfates, but no detailed study was devoted to other meso-ionic compounds.

JP-A-1-201659 discloses addition of a meso-ionic thiolate compound to a fixing bath or a bleach-fix bath as a bleaching accelerator, and JP-A-2-44355 discloses addition of a 1,2,4-triazolium-3-thiolate compound to a fixing bath as a fixing accelerator. However, these publications contain no reference to use of the specific meso-ionic compounds according to the present invention shown below as a fixing agent nor yet the effects purposed by the present invention.

Other known meso-ionic compounds include those disclosed in U.S. Pat. Nos. 4,003,910, 4,675,276, 4,624,913, and 4,631,253, JP-A-62-217237, JP-A-64-3641, JP-A-60-144737, JP-A-62-253161, JP-A-62-287239, JP-A-61-176920, JP-A-62-96943, and JP-A-1-154056. These compounds have been developed for use as an additive to photographic materials or an additive to a developing solution, and there is no disclosure about the effects aimed by the present invention shown below.

On the other hand, improvement in image preservability has also been demanded. Studies have been directed to both materials of photographic materials and the final bath of processing but not yet reached sufficient results.

Thus, both of bath stability and image stability have not yet been improved to satisfaction, and it has been needed to take a drastic measure therefor.

SUMMARY OF THE INVENTION

An object of the present invention is provide a method for processing a silver halide photographic material in which a fixing bath and subsequent baths have excellent stability and which prevents thermostain of a processed silver halide photographic material.

It has now been found that the above object of this invention is accomplished by using a meso-ionic compound other than meso-ionic 1,2,4-triazolium-3-thiolate compounds as a fixing agent.

The present invention relates to a method for processing a silver halide photographic material comprising a support having thereon at least one light-sensitive silver halide emulsion layer, which comprises the steps of developing and fixing the image-wise exposed silver halide photographic material, wherein the fixing bath used in the fixing step contains at least one meso-ionic compound other than meso-ionic 1,2,4-triazolium-3-thiolate compounds.

DETAILED DESCRIPTION OF THE INVENTION

Meso-ionic compounds as referred to in the present invention are a group of compounds defined by W. Baker and W. D. Ollis as "5- or 6-membered heterocyclic compounds which cannot be represented satisfactorily by any one covalent or polar structure and possesses a sextet of $\pi$electrons in association with the atoms comprising the ring. The ring bears a fractional positive charge balanced by a corresponding negative charge located on a covalently attached atom or group of atoms" as described in *Quart. Rev.*, Vol. 11, p. 15 (1957) and *Advances in Heterocyclic Chemistry*, Vol. 19, p. 4 (1976).

In the present invention, preferred of these meso-ionic compounds are those represented by formula (I):

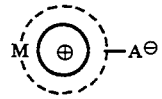

(I)

wherein M represents a 5- or 6-membered heterocyclic ring composed of at least one member selected from the group consisting of a carbon atom, a nitrogen atom, an oxygen atom, a sulfur atom and a selenium atom; and $A^{\theta}$ represents $—O^{\theta}$, $—S^{\theta}$ or $—N^{\theta}—R$, wherein R represents an alkyl group (preferably having 1 to 6 carbon atoms), a cycloalkyl group (preferably having 3 to 6 carbon atoms), an alkenyl group (preferably having 2 to 6 carbon atoms), an alkynyl group (preferably having 2 to 6 carbon atoms), an aralkyl group, an aryl group (preferably having 6 to 12 carbon atoms), or a heterocyclic group (preferably having 1 to 6 carbon atoms);

provided that meso-ionic 1,2,4-triazolium-3-thiolate compounds are excluded from formula (I).

In formula (I), examples of the 5-membered heterocyclic ring as represented by M include an imidazolium ring, a pyrazolium ring, an oxazolium ring, an isoxazolium ring, a thiazolium ring, an isothiazolium ring, a 1,3-dithiol ring, a 1,3,4- or 1,2,3-oxadiazolium ring, a 1,3,2-oxathiazolium ring, a 1,2,3-triazolium ring, a 1,3,4-triazolium ring exclusive of its thiolate, a 1,3,4-, 1,2,3- or 1,2,4-thiadiazolium ring, a 1,2,3,4-oxatriazolium ring, a 1,2,3,4-tetrazolium ring, and a 1,2,3,4-thiatriazolium ring.

R represents a substituted or unsubstituted alkyl group (e.g., methyl, ethyl, n-propyl, n-butyl, isopropyl, n-octyl, ethoxycarbonylmethyl, dimethylaminoethyl), a substituted or unsubstituted cycloalkyl group (e.g., cyclohexyl, 4-methylcyclohexyl, cyclopentyl), a substituted or unsubstituted alkenyl group (e.g., propenyl, 2-methylpropenyl), a substituted or unsubstituted alkynyl group (e.g., propargyl, butynyl, 1-methylpropargyl), a substituted or unsubstituted aralkyl group (e.g., benzyl, 4-methoxybenzyl), a substituted or unsubstituted aryl group (e.g., phenyl, naphthyl, 4-methylphenyl, 3-methoxyphenyl, 4-ethoxycarbonylphenyl), or a substituted or unsubstituted heterocyclic ring (e.g., pyridyl, imidazolyl, morpholino, triazolyl, tetrazolyl, thienyl).

The heterocyclic ring represented by M may be substituted with a nitro group, a halogen atom (e.g., chlorine, bromine), a mercapto group, a cyano group, a substituted or unsubstituted alkyl group (e.g., methyl, ethyl, propyl, t-butyl, methoxyethyl, methylthioethyl, dimethylaminoethyl, morpholinoethyl, methylthiomethyl, methoxyethoxyethoxyethyl, trimethylammonioethyl, cyanoethyl, phosphonomethyl, phosphonoethyl), a substituted or unsubstituted aryl group (e.g., phenyl, 4-methanesulfonamidophenyl, 4-methylphenyl, 3-methoxyphenyl, 4-dimethylaminophenyl, 3,4-dichlorophenyl, naphthyl), a substituted or unsubstituted alkenyl group (e.g., allyl), a substituted or unsubstituted cycloalkyl group (e.g., cyclohexyl, cyclopentyl), a substituted or unsubstituted alkynyl group (e.g., propargyl), a substituted or unsubstituted aralkyl group (e.g., benzyl, 4-methylbenzyl, phenethyl, 4-methoxybenzyl), a substituted or unsubstituted alkoxy group (e.g., methoxy, ethoxy, methoxyethoxy, methylthioethoxy, dimethylaminoethoxy), a substituted or unsubstituted aryloxy group (e.g., phenoxy, 4-methoxyphenoxy), a substituted or unsubstituted alkylthio group (e.g., methylthio, ethylthio, propylthio, methylthioethylthio, dimethylaminoethylthio, methoxyethylthio), a substituted or unsubstituted arylthio group (e.g., phenylthio, 4-dimethylaminophenylthio), a substituted or unsubstituted heterocyclic oxy group (e.g., 2-pyridyloxy, 2-imidazolyloxy), a substituted or unsubstituted heterocyclic thio group (e.g., 2-benzothiazolylthio, 4-pyrazolylthio), a substituted or unsubstituted sulfonyl group (e.g., methanesulfonyl, ethanesulfonyl, p-toluenesulfonyl, methoxyethylsulfonyl), a substituted or unsubstituted carbamoyl group (e.g., unsubstituted carbamoyl, methylcarbamoyl, dimethylaminoethylcarbamoyl, methoxyethylcarbamoyl, methylthioethylcarbamoyl, phenylcarbamoyl), a substituted or unsubstituted thiocarbamoyl group (e.g., dimethylthiocarbamoyl), a substituted or unsubstituted sulfamoyl group (e.g., unsubstituted sulfamoyl, methylsulfamoyl, imidazolylethylsulfamoyl, phenylsulfamoyl), a substituted or unsubstituted carbonamido group (e.g., acetamido, benzamido, methoxypropionamido, dimethylaminopropionamido), a substituted or unsubstituted sulfonamido group (e.g., methanesulfonamido, benzenesulfonamido, p-toluenesulfonamido), a substituted or unsubstituted acyloxy group (e.g., acetyloxy, benzoyloxy), a substituted or unsubstituted sulfonyloxy group (e.g, methanesulfonyloxy), a substituted or unsubstituted ureido group (e.g., unsubstituted ureido, methylureido, ethylureido, methoxyethylureido, dimethylaminopropylureido, methylthioethylureido, morpholinoethylureido, phenylureido), a substituted or unsubstituted thioureido group (e.g., unsubstituted thioureido, methylthioureido, methoxyethylthioureido), a substituted or unsubstituted sulfamoylamino group (e.g., unsubstituted sulfamoylamino, dimethylsulfamoylamino), a substituted or unsubstituted acyl group (e.g., acetyl, benzoyl, 4-methoxybenzoyl), a substituted or unsubstituted thioacyl group (e.g, thioacetyl), a substituted or unsubstituted heterocyclic group (e.g., 1-morpholino, 1-piperidino, 2-pyridyl, 4-pyridyl, 2-thienyl, 1-pyrazolyl, 1-imidazolyl, 2-tetrahydrofuryl, tetrahydrothienyl), a substituted or unsubstituted oxycarbonyl group (e.g., methoxycarbonyl, phenoxycarbonyl, methoxyethoxycarbonyl, methylthioethoxycarbonyl, methoxyethoxyethoxyethoxycarbonyl, dimethylaminoethoxycarbonyl, morpholinoethoxycarbonyl), a substituted or unsubstituted oxycarbonylamino group (e.g., methoxycarbonylamino, phenoxycarbonylamino, 2-ethylhexyloxycarbonylamino), a substituted or unsubstituted amino group (e.g., unsubstituted amino, dimethylamino, methoxyethylamino, anilino), a carboxyl group or a salt thereof, a sulfo group or a salt thereof, a hydroxyl group, etc.

The compounds represented by formula (I) may be in the form of their salts, including an acetate, a nitrate, a salicylate, a hydrochloride, an iodate, and a bromate.

In formula (I), $A^{\theta}$ preferably represents $-S^{\theta}$.

Of the meso-ionic compounds of formula (I), more preferred are those represented by formula (II):

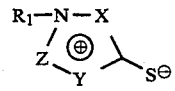

(II)

wherein X represents N or C-$R_2$; Y represents O, S, N or N-$R_3$; and Z represents N, N-$R_4$ or C-$R_5$; $R_1$, $R_2$, $R_3$, $R_4$, and $R_5$, which may be the same or different, each represents an alkyl group, a cycloalkyl group, an alkenyl, group, an alkynyl group, an aralkyl group, an aryl group, a heterocyclic group, an amino group, an acylamino group, a sulfonamido group, a ureido group, a sulfamoylamino group, an acyl group, a thioacyl group, a carbamoyl group, or a thiocarbamoyl group; or $R_2$ and $R_5$ each represents a hydrogen atom; or $R_1$ and $R_2$, $R_1$ and $R_4$, $R_1$ and $R_5$, $R_3$ and $R_4$, or $R_3$ and $R_5$ may be connected to each other to form a ring; provided that when X is N, Y is not N-$R_5$ and Z is not C-$R_5$.

In formula (II), $R_1$, $R_2$, $R_3$, $R_4$, and $R_5$ each represents a substituted or unsubstituted alkyl group (e.g., methyl, ethyl, n-propyl, t-butyl, methoxyethyl, methylthioethyl, dimethylaminoethyl, morpholinoethyl, dimethylaminoethylthioethyl, aminoethyl, methylthiomethyl, trimethylammonioethyl, phosphonomethyl, phosphonoethyl), a substituted or unsubstituted cycloalkyl group (e.g., cyclohexyl, cyclopentyl, 2-methylcyclohexyl), a substituted or unsubstituted alkenyl group (e.g., allyl, 2-methylallyl), a substituted or unsubstituted alkynyl group (e.g., propargyl), a substituted or unsubstituted aralkyl group (e.g., benzyl, phenethyl, 4-methoxybenzyl), a substituted or unsubstituted aryl group (e.g., phenyl, naphthyl, 4-methylphenyl, 4-methoxyphenyl, 4-carboxyphenyl, 4-sulfophenyl, 3,4-disulfophenyl), a substituted or unsubstituted heterocyclic group (e.g., 2-, 3- or 4-pyridyl, 2-thienyl, 1-pyrazolyl, 1-imidazolyl, 2-tetrahydrofuryl), a substituted or unsubstituted amino group (e.g., unsubstituted amino, dimethylamino, methylamino), a substituted or unsubstituted acylamino group (e.g., acetylamino, benzoylamino, methoxypropionylamino), a substituted or unsubstituted sulfonamido group (e.g., methanesulfonamido, benzenesulfonamido, 4-toluenesulfonamido), a substituted or unsubstituted ureido group (e.g., unsubstituted ureido, 3-methylureido), a substituted or unsubstituted sulfamoylamino group (e.g., unsubstituted sulfamoylamino, 3-methylsuflamoylamino), a substituted or unsubstituted acyl group (e.g., acetyl, benzoyl), a substituted or unsubstituted thioacyl group (e.g., thioacetyl), a substituted or unsubstituted carbamoyl group (e.g., unsubstituted carbamoyl, dimethylcarbamoyl), or a substituted or unsubstituted thiocarbamoyl group (e.g., dimethylthiocarbamoyl). In addition, $R_2$ and $R_5$ may represent a hydrogen atom.

In preferred compounds represented by formula (II), X represents N or C-$R_2$; Y represents N-$R_3$, S or O; Z represents N or C-$R_5$; and $R_1$, $R_2$, and $R_5$ each represents a substituted or unsubstituted alkyl group, a substituted or unsubstituted alkenyl group, a substituted or unsubstituted alkynyl group, or a substituted or unsubstituted heterocyclic ring; or $R_2$ and $R_5$ each represent a hydrogen atom; and $R_3$ represents a substituted or unsubstituted alkyl group, a substituted or unsubstituted alkenyl group, a substituted or unsubstituted alkynyl group, a substituted or unsubstituted heterocyclic group, a substituted or unsubstituted amino group, a substituted or unsubstituted thioacyl group, or a substituted or unsubstituted thiocarbamoyl group.

In more preferred compounds of formula (II), X, Y, and Z are combined as follows.

(II-A) X=N; Y=O; Z=C-$R_5$
(II-B) X=N; Y=S; Z=C-$R_5$
(II-C) X=C-$R_2$; Y=N-$R_3$; Z=C-$R_5$
(II-D) X=C-$R_2$; Y=S; Z=C-$R_5$
(II-E) X=C-$R_2$; Y=N-$R_3$; Z=N
(wherein $R_2$, $R_3$, and $R_5$ are as defined above)

Specific examples of the meso-ionic compounds according to the present invention are shown below for illustrative purposes only but not for limitation.

1.
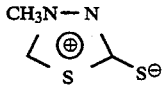

2.
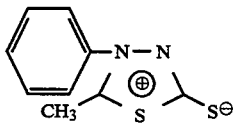

3.
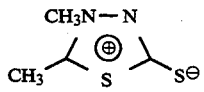

-continued

4.
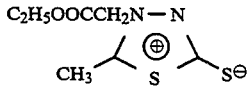

5.
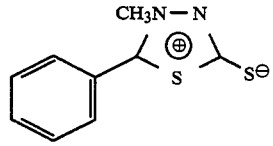

6.
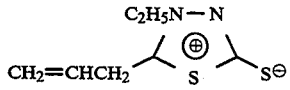

7.
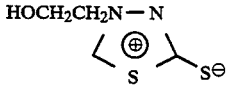

8.
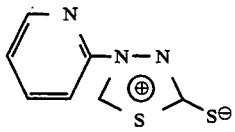

9.
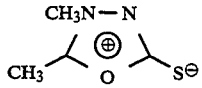

10.
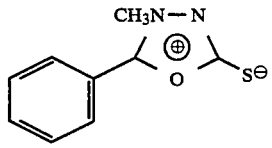

11.
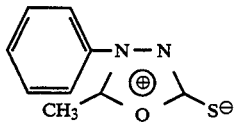

12.
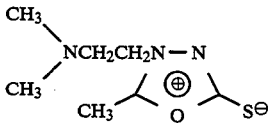

13.
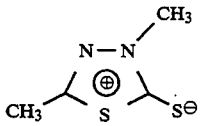

14.
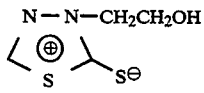

15.
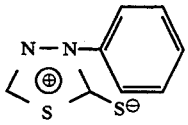

-continued
16.
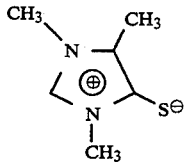
17.
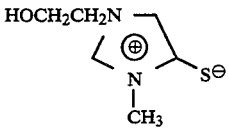
18.
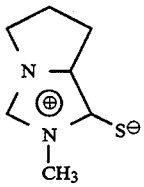
19.
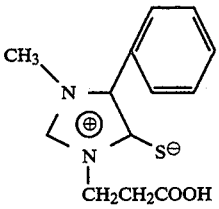
20.
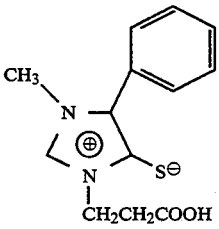
21.
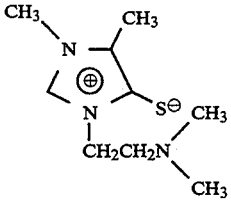
22.
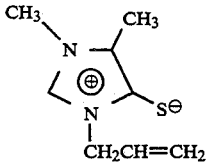
23.
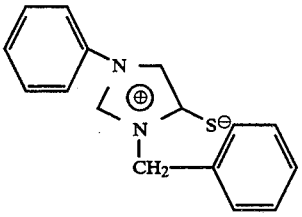
-continued
24.
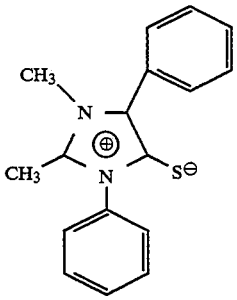
25.
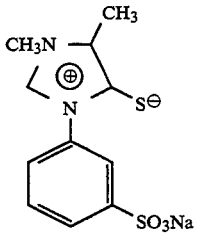
26.
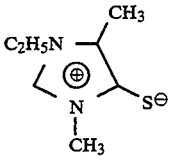
27.
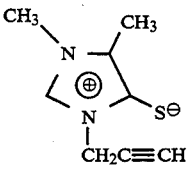
28.
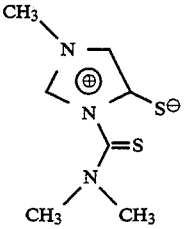
29.
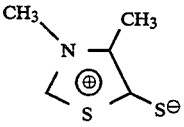
30.
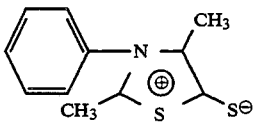
31.
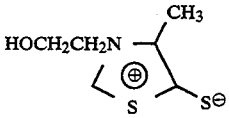

-continued
32.
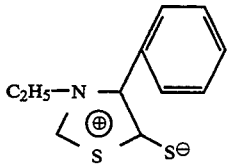
33.
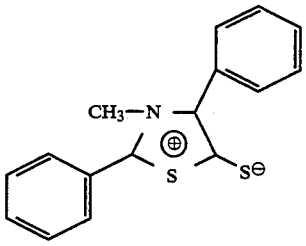
34.
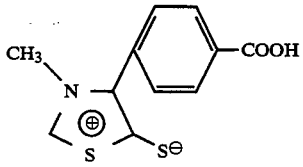
35.
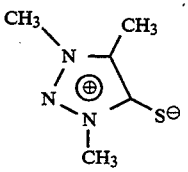
36.
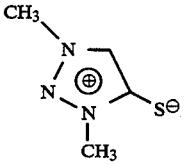
37.
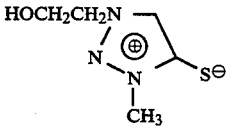
38.
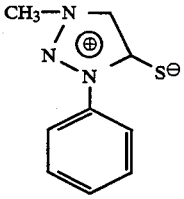
39.
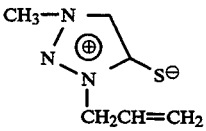
-continued
40.
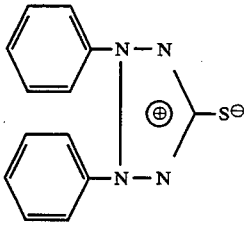
41.
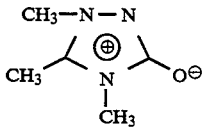
42.
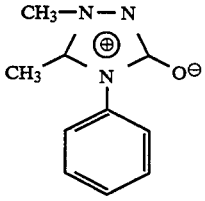
43.
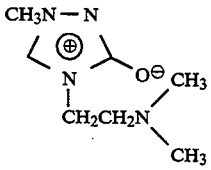
44.
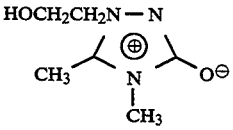
45.
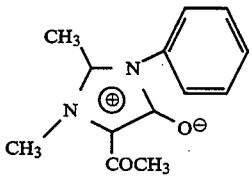
46.
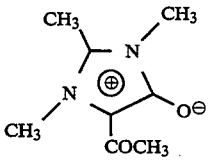
47.
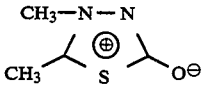
48.
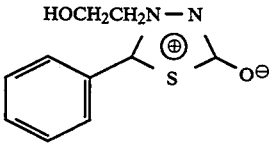

-continued

49.

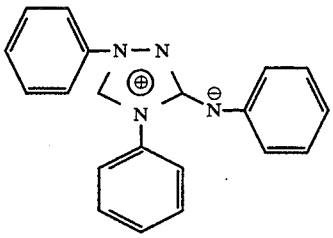

50.

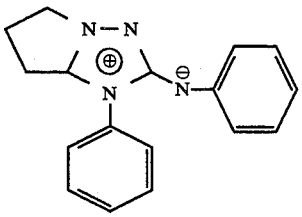

51.

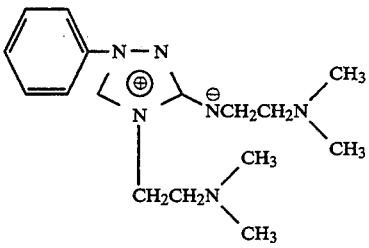

52.

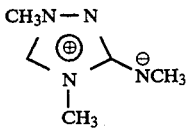

53.

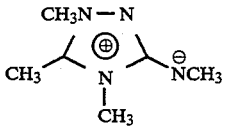

54.

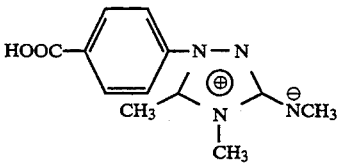

55.

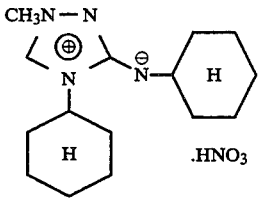

56.

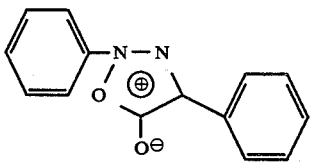

-continued

57.

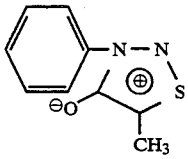

58.

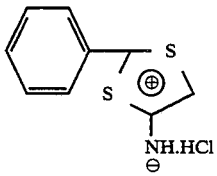

59.

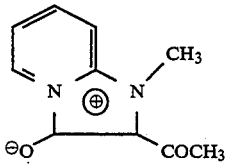

60.

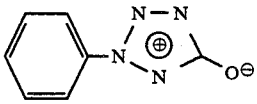

61.

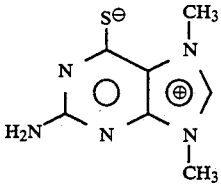

The compounds represented by formula (I) or (II) can be synthesized by known processes described, e.g., in *J. Heterocyclic Chem.*, Vol. 2, p. 105 (1965), *J. Org. Chem.*, Vol. 32, p. 2245 (1967), *J. Am. Chem. Soc.*, Vol. 80, p. 1895 (1958), *Chem. Commun.*, p. 1222 (1971), *Berichte der Deutschen Chemischen Gesellschaft*, Vol. 38, p. 4049 (1905), *J. Chem. Soc. Commun.*, p. 1224 (1971), JP-A-60-122936, JP-A-60-117240, *Advances in Heterocyclic Chemistry*, Vol. 19, p. 1 (1976), *Tetrahedron Letters*, p. 5881 (1968), *J. Heterocyclic Chem.*, Vol. 5, p. 277 (1968), *J. Chem. Soc., Perkin Trans. I*, p. 627 (1974), *Tetrahedron Letters*, p. 1809 (1967), ibid., p. 1578 (1971), *J. Chem. Soc.*, p. 899 (1935), ibid, p. 2865 (1959), and *J. Org. Chem.*, Vol. 30, p. 567 (1965).

The compound of the present invention is used in a fixing bath usually in a concentration ranging from $1\times10^{-5}$ to 10 mol/l, preferably from $1\times10^{-3}$ to 3 mol/l, and more preferably from 0.1 to 3 mol/l.

More specifically, the compound is preferably used in a concentration of from 0.5 to 2 mol/l where a silver halide emulsion in a light-sensitive material to be processed has a halogen composition of AgBrI (I≧2 mol %), or of from 0.1 to 1 mol/l where the silver halide emulsion has a halogen composition of AgBr, AgBrCl or a high silver chloride content (AgCl≧80 mol %).

As previously stated, there has been a demand for each processing solution to have further improved stability with a tendency to reduction of replenishment. The outstanding problem associated with the improvement of stability of a fixing bath and the subsequent washing bath consists in precipitation of a sulfide resulting from oxidative deterioration of a thiosulfate used as a fixing agent. Occurrence of the problem in a washing bath is due to carry-over of the fixing solution into the washing bath during processing. While a sulfite is commonly used as an antioxidant to prevent such precipitation, an improvement in stability as required in a reduced replenishment system cannot be achieved any more simply by increasing the amount of a sulfite on an account of a problem of solubility or a problem of formation of Glauber's salt accompanying oxidation of the sulfite.

The present inventors have conducted extensive investigations on a fixing agent exhibiting excellent stability against oxidation which would substitute for thiosulfates and, as a result, found that meso-ionic compounds are stable against oxidation and cause no precipitation even in a reduced replenishment system while possessing sufficient fixing ability. A fixing bath containing such a meso-ionic compound was proved to exhibit satisfactory bath stability without suffering from precipitation even in the co-presence of a thiosulfate.

Further investigation on various meso-ionic compounds surprisingly revealed that compounds having a skeleton other than a meso-ionic 1,2,4-triazolium-3-thiolate structure bring about considerable improvement in thermal image preservability. Such an unexpected effect is considered, though unclear, attributed to a difference in the manner of uptake of a meso-ionic compound into a dye (oil) depending on the skeleton structure, giving influences on image preservability.

Direct or indirect addition of the compound of the present invention to a washing bath or a stabilizing bath also produces effects in prevention of precipitation in the respective bath and in reduction of thermostain of the processed photographic material. A suitable concentration of the compound in the washing or stabilizing bath is from $10^{-3}$ to 0.5 times that in the prebath (i.e., the concentration of a fixing agent in the fixing bath).

The present invention will be described in detail with reference to silver halide color photographic materials.

Silver halide color photographic materials to which the present invention is applied comprise a support having thereon at least one of blue-sensitive, green-sensitive, and red-sensitive silver halide emulsion layers. The number and order of silver halide emulsion layers and light-insensitive layers are not particularly limited. A typical material comprises a support having thereon at least one light-sensitive layer composed of two or more silver halide emulsion layers which have substantially the same color sensitivity to blue light, green light or red light but are different in photosensitivity (hereinafter referred to as unit light-sensitive layer). Multilayer silver halide color photographic materials generally comprise a support having thereon a red-sensitive unit layer, a green-sensitive unit layer, and a blue-sensitive unit layer in this order. Depending on the end use, the above order of unit layers may be altered, or two layers having the same color sensitivity may have therebetween a layer having different color sensitivity.

A light-insensitive layer, including various intermediate layers, may be provided between these silver halide light-sensitive layers or as an uppermost or undermost layer.

Such intermediate layers may contain couplers, DIR compounds, etc. as described in JP-A-61-43748, JP-A-59-113438, JP-A-59-113440, JP-A-61-20037, and JP-A-61-20038 and may also contain color mixing preventive agents as is usual.

Each unit light-sensitive layer preferably has a two-layer structure composed of a high sensitive emulsion layer and a low sensitive emulsion layer as described in West German Patent 1,121,470 and British Patent 923,045. The two layers of each unit light-sensitive layer are generally provided in a descending order of photosensitivity toward the support. Between the two silver halide emulsion layers, a light-insensitive layer may be provided. It is also possible to provide a low sensitive emulsion layer on the side farther from the support and a high sensitive emulsion layer on the side closer to the support as described in JP-A-57-112751, JP-A-62-200350, JP-A-62-206541, and JP-A-62-206543.

Specific examples of practical layer orders include an order of low sensitive blue-sensitive layer (BL)/high sensitive blue-sensitive layer (BH)/high sensitive green-sensitive layer (GH)/low sensitive green-sensitive layer (GL)/high sensitive red-sensitive layer (RH)/low sensitive red-sensitive layer (RL)/support, an order of BH/BL/GL/GH/RH/RL/support, and an order of BH/BL/GH/GL/RL/RH/support.

A layer order of blue-sensitive layer/GH/RH/GL/RL/support as described in JP-B-55-34932 (the term "JP-B" as used herein means an "examined Japanese patent publication") and a layer order of blue-sensitive layer/GL/RL/GH/RH/support as described in JP-A-56-25738 and JP-A-62-63936 are also employable.

Further, a unit light-sensitive layer may be composed of three layers whose photosensitivity differs in a descending order toward the support, i.e., the most sensitive silver halide emulsion layer as the upper layer, a middle sensitive silver halide emulsion layer as an intermediate layer, and the least sensitive silver halide emulsion layer as the lower layer, as proposed in JP-B-49-15495. Three layers of different sensitivity may be arranged in an order of middle sensitive emulsion layer/high sensitive emulsion layer/low sensitive emulsion layer/support as described in JP-A-59-202464.

As mentioned above, a layer structure or arrangement of light-sensitive materials can be appropriately chosen according to the end use.

Where the silver halide color photographic material is a color negative film or a color reversal film, the photographic emulsion layer thereof preferably comprises silver iodobromide, silver iodochloride or silver iodochlorobromide having a silver iodide content of not more than about 30 mol %, and more preferably silver iodobromide or silver iodochlorobromide having a silver iodide content of from about 2 mol % to about 25 mol %.

In the case of color papers, the photographic emulsion layer thereof preferably comprises silver chlorobromide or silver chloride having substantially no silver iodide content. The term "substantially no silver iodide content" as used herein means not more than 1 mol %, and preferably not more than 0.2 mol %, of silver iodide content. Such a substantially iodide-free emulsion may have an arbitrary silver bromide/silver chloride composition. The silver bromide/silver chloride ratio is selected from a broad range, but a preferred silver chloride content is 2 mol % or more. So-called high silver chloride emulsions having a high silver chloride content are preferably used in light-sensitive materials suited for rapid processing. A preferred silver chloride content in such high silver chloride emulsions is 90 mol % or more, and particularly 95 mol % or more. For the purpose of reducing replenishment for a developing solution, an emulsion comprising almost pure silver chloride with a silver chloride content ranging from 98 to 99.9 mol % is also preferred.

Silver halide grains of the photographic emulsions may have a regular crystal form, such as a cubic form, an octahedral form, and a tetradecahedral form; an irregular crystal form, such as a spherical form and a plate form; a crystal form having a crystal defect, such as a twinning plane; or a composite crystal form thereof.

The silver halide grains have a wide range of grain size, including from fine grains of about 0.2 μm or smaller to large grains having a projected area diameter reaching about 10 μm. The silver halide emulsion may be either a mono-dispersed emulsion or a poly-dispersed emulsion.

Silver halide photographic emulsions which are used in the present invention can be prepared by the processes described, e.g., in *Research Disclosure* (hereinafter abbreviated as RD), No. 17643 (December, 1978), pp. 22–23, "I. Emulsion Preparation and Types", and ibid, No. 18716 (November, 1979), p. 648, P. Glafkides, *Chemic et Phisique Photographique*, Paul Montel (1967), G. F. Duffin, *Photographic Emulsion Chemistry*, Focal Press (1966), and V. L. Zelikman et al., *Making and Coating Photographic Emulsion*, Focal Press (1964).

Mono-dispersed emulsions described in U.S. Pat. Nos. 3,574,628 and 3,655,394 and British Patent 1,413,748 are preferably used as well.

Tabular grains having an aspect ratio of about 5 or more are also useful. Such tabular grains can easily be prepared by the processes described, e.g., in Gutoff, *Photographic Science and Engineering*, Vol. 14, pp. 248–257 (1970), U.S. Pat. Nos. 4,434,226, 4,414,310, 4,433,048, and 4,439,520, and British Patent 2,112,157.

The silver halide grains may be homogeneous grains having a uniform crystal structure throughout the individual grains or heterogeneous grains including those in which the inside and the outer shell have different halogen compositions, those in which the halogen composition differs among layers, and those having fused thereto silver halide of different halogen composition through epitaxy. Silver halide grains fused with compounds other than silver halides, e.g., silver rhodanide or lead oxide may also be used. A mixture comprising grains of various crystal forms is employable.

Silver halide emulsions are usually subjected to physical ripening, chemical sensitization, and spectral sensitization. During physical ripening, various polyvalent metal ion dopants (e.g., salts or complex salts of cadmium, zinc, lead, thallium, iron, ruthenium, rhodium, palladium, osmium, iridium, or platinum) may be introduced into am emulsion. Additives which can be used in chemical sensitization are described in JP-A-62-215272. Additives which can be used in the above steps are described in RD, Nos. 17643 and 18716 as listed below. Other known photographic additives which can be used in the present invention are also described therein as listed below.

| Additive | RD 17643 | RD 18716 |
|---|---|---|
| 1. Chemical Sensitizer | p. 23 | p. 648, right column (RC) |
| 2. Sensitivity Increasing Agent | | p. 648, right column (RC) |
| 3. Spectral Sensitizer, Supersensitizer | pp. 23–24 | p. 648, RC to p. 649, RC |

-continued

| Additive | RD 17643 | RD 18716 |
|---|---|---|
| 4. Brightening Agent | p. 24 | |
| 5. Antifoggant and Stabilizer | pp. 24–25 | p. 649, RC |
| 6. Light Absorber, Filter Dye, Ultraviolet Absorber | pp. 25–26 | p. 649, RC to p. 650, left column (LC) |
| 7. Stain Inhibitor | p. 25, RC | p. 650, LC to RC |
| 8. Dye Image Stabilizer | p. 25 | |
| 9. Hardening Agent | p. 26 | p. 651, LC |
| 10. Binder | p. 26 | p. 651, LC |
| 11. Plasticizer, Lubricant | p. 27 | p. 650, RC |
| 12. Coating Aid, Surface Active Agent | pp. 26–27 | p. 650, RC |
| 13. Antistatic Agent | p. 27 | p. 650, RC |

In order to prevent deterioration in photographic performance due to formaldehyde gas, a compound capable of reacting with formaldehyde to fix it as described in U.S. Pat. Nos. 4,411,987 and 4,435,503 is preferably added to light-sensitive materials.

Various couplers can be used in the color photographic materials which can be used in the present invention. Specific examples of useful couplers are described in patents cited in RD., No. 17643, supra, VII-C to G.

Examples of suitable yellow couplers are described, e.g., in U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Examples of suitable magenta couplers include 5-pyrazolone couplers and pyrazoloazole couplers. Examples of particularly preferred magenta couplers are described in U.S. Pat. Nos. 4,310,619 and 4,351,897, European Patent 73,636, U.S. Pat. Nos. 3,061,432 and 3,725,064, RD No. 24220 (June, 1984), JP-A-60-33552, RD No. 24230 (June, 1984), JP-A-60-43659, JP-A-61-72238, JP-A-60-35730, JP-A-55-118034, JP-A-60-185951, U.S. Pat. Nos. 4,500,630, 4,540,654, and 4,556,630, and WO (PCT) 88/04795.

Cyan couplers include phenol couplers and naphthol couplers. Examples of suitable couplers are described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, EP 121,365A, EP 249,453A, U.S. Pat. Nos. 3,446,622, 4,333,999, 4,753,871, 4,451,559, 4,427,767, 4,690,889, 4,254,212, and 4,296,199, and JP-A-61-42658.

Examples of suitable colored couplers which can be used for correcting unnecessary absorption of a developed dye are described in RD, No. 17643, VII-G, U.S. Pat. No. 4,163,670, JP-B- 57-39413, U.S. Pat. Nos. 4,004,929 and 4,138,258 and British Patent 1,146,368. Further, couplers capable of releasing a fluorescent dye upon coupling with which unnecessary absorption of a developed dye is corrected as described in U.S. Pat. No. 4,774,181 and couplers having a dye precursor group as a releasable group which are capable of reacting with a developing agent to form a dye as described in U.S. Pat. No. 4,777,120 are preferably used.

Examples of suitable couplers which develop a dye having moderate diffusibility are described in U.S. Pat. No. 4,366,237, British Patent 2,125,570, European Patent 96,570, and West German Patent Application (OLS) No. 3,234,533.

Typical examples of polymerized dye-forming couplers are described in U.S. Pat. Nos. 3,451,820, 4,080,211, 4,367,282, 4,409,320, and 4,576,910, and British Patent 2,102,173.

Couplers capable of releasing a photographically useful residue on coupling are also used to advantage. Examples of suitable DIR couplers which release a development inhibitor are described in patents cited in RD, No. 17643, VII-F, JP-A-57-151944, JP-A-57-154234, JP-A-60-184248, JP-A-63-37346, and U.S. Pat. Nos. 4,248,962 and 4,782,012.

Examples of suitable couplers which imagewise release a nucleating agent or a development accelerator at the time of development are described in British Pat. Nos. 2,097,140 and 2,131,188, JP-A-59-157638, and JP-A-59-170840.

Couplers which can be additionally used in the light-sensitive material of the present invention include competing couplers as described in U.S. Pat. No. 4,130,427; polyequivalent couplers as described in U.S. Pat. Nos. 4,283,472, 4,338,393, and 4,310,618; couplers capable of releasing a DIR redox compound, a DIR coupler, a DIR coupler-releasing redox compound, or a DIR redox-releasing redox compound as described in JP-A-60-185950 and JP-A-62-24252; couplers capable of releasing a dye which restores its color after release as described in EP 173,302A; couplers capable of releasing a bleaching accelerator as described in RD, No. 11449, RD, No. 24241, and JP-A-61-201247; couplers capable of releasing a ligand as described in U.S. Pat. No. 4,553,477; couplers capable of releasing a leuco dye as described in JP-A-63-75747; and couplers capable of releasing a fluorescent dye as described in U.S. Pat. No. 4,774,181.

These couplers are introduced into photographic materials by various known dispersion methods. High-boiling organic solvents which are useful in a oil-in-water dispersion method are described, e.g., in U.S. Pat. No. 2,322,027. Specific examples of the high-boiling organic solvents having a boiling point of 175° C. or higher under atmospheric pressure are phthalic esters (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate), phosphoric or phosphonic esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoic acid esters (e.g., 2-ethylhexyl benzoate, dodecyl benzoate, 2-ethylhexyl p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-t-amylphenol), aliphatic carboxylic acid esters (e.g., bis(2-ethylhexyl) sebacate, dioctyl azelate, glycerol tributyrate, isostearyl lactate, trioctyl citrate), aniline derivatives (e.g., N,N-dibutyl-2-butoxy-5-t-octylaniline), and hydrocarbons (e.g., paraffin, dodecylbenzene, diisopropylnaphthalane). Organic solvents having a boiling point of not lower than about 30° C., and preferably from 50° C. to about 160° C. may be used in combination as an auxiliary solvent. Typical examples of such an auxiliary solvent are ethyl acetate, butyl acetate, ethyl propionate, methyl ethyl ketone, cyclohexanone, 2-ethoxyethyl acetate, and dimethylformamide.

With respect to a latex dispersion method, the steps involved, the effects, and specific examples of impregnating latices are described in U.S. Pat. No. 4,199,363 and West German Patent Application (OLS) Nos. 2,541,274 and 2,541,230.

In addition, the couplers may be emulsified and dispersed in a hydrophilic colloid aqueous solution by impregnating in a loadable latex polymer in the presence or absence of the above-mentioned high-boiling organic solvent (see, for example, U.S. Pat. No. 4,203,716) or by dissolving in a water-insoluble or organic solvent-soluble polymer. In this case, a homo- or copolymer described in International Publication WO 88/00723, pp. 12–30 is preferably used. An acrylamide polymer is particularly preferred from the standpoint of dye image stabilization.

The present invention can be applied to a wide variety of color light-sensitive materials, for example, color negative films for general use or for movies, color reversal films for slides or TV, color papers, direct positive color light-sensitive materials, color positive films, and color reversal papers.

Examples of supports which can be suitably used in the color light-sensitive materials are described, e.g., in RD, No. 17643, p. 28, and ibid., No. 18716, pp. 647 (right column) to 648 (left column).

In the color light-sensitive materials, the hydrophilic colloidal layers on the side having emulsion layers preferably have a total film thickness of not more than 25 μm (more preferably not more than 20 μm) and a rate of swell $T_{178}$ of not more than 30 seconds (more preferably not more than 15 seconds). The terminology "total film thickness" as used herein means a film thickness as measured after conditioning at 25° C. and a relative humidity of 55% for 2 days. The terminology "rate of swell $T_{\frac{1}{2}}$" means a time required for a color light-sensitive material to be swollen to ½ the saturated swollen thickness, the saturated swollen thickness being defined to be 90% of the maximum swollen thickness which is reached when the color light-sensitive material is swollen with a color developing solution at 30° C. for 3 minutes and 15 seconds. The rate of swell can be determined by methods known in the art using, for example, a swellometer of the type described in A. Green, et al., *Photographic Science and Engineering*, Vol. 19, No. 2, pp. 124–129.

The rate of swell $T_{\frac{1}{2}}$ can be controlled by adding a hardening agent for a gelatin binder or by varying aging conditions after coating.

Further, the light-sensitive material preferably has a degree of swelling of from 150 to 400%. The terminology "degree of swelling" as used herein means a value obtained from the maximum swollen film thickness as defined above according to formula: (maximum swollen film thickness—film thickness)/film thickness.

The above-described color photographic materials can be development processed according to usual methods as described in RD, No. 17643, pp. 28–29 and ibid, p. 615, left to right columns.

A color developing solution to be used for development processing is preferably an alkaline aqueous solution containing an aromatic primary amine color developing agent. Useful color developing agents include aminophenol compounds and preferably p-phenylenediamine compounds. Typical examples of p-phenylenediamine compounds are 3 -methyl-4 -amino-N,N-diethylaniline, 3-methyl-4-amino-N-ethyl-N-β-hydroxyethylaniline, 3-methyl-4-amino-N-ethyl- N-β-methanesulfonamidoethylaniline, 3-methyl-4-amino-N-ethyl-β-methoxyethylaniline, and salts thereof (e.g., sulfates, hydrochlorides, and p-toluenesulfonates). These developing agents may be used either individually or in combination of two or more thereof according to the purpose.

The color developing solution usually contains a pH buffering agent, e.g., carbonates, borates or phosphates of alkali metals, and a development inhibitor or an antifoggant, e.g., bromides, iodides, benzimidazoles, benzothiazoles, and mercapto compounds. If desired, the color developing solution further contains various preservatives, such as hydroxylamine, diethylhydroxylamine, hydrazine sulfites, phenyl semicarbazides, triethanolamine, catecholsulfonic acids, triethylenediamine (1,4-diazabicyclo[2,2,2-octane); organic solvents, e.g., ethylene glycol and diethylene glycol; development accelerators, e.g., benzyl alcohol, polyethylene glycol, quaternary ammonium salts, and amines; dye-forming couplers; competing couplers; fogging agents, e.g., sodium boronhydride; auxiliary developing agents, e.g., 1-phenyl-3-pyrazolidone; viscosity-imparting agents; various chelating agents, such as aminopolycarboxylic acids, aminopolyphosphonic acids, alkylphosphonic acids; and phosphonocarboxylic acids (e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid), and salts thereof); fluorescent brightening agents, e.g., 4,4'-diamino-2,2'-disulfostilbene compounds; and various surface active agents, such as alkylsulfonic acids, arylsulfonic acids, aliphatic carboxylic acids, and aromatic carboxylic acids.

It should be noted, however, that the color developing solution preferably contains substantially no benzyl alcohol from the viewpoint of prevention of environmental pollution, ease in preparation of a developing solution, and prevention of color stain. The term "substantially no benzyl alcohol" as above referred to means that the content of benzyl alcohol in the color developing solution is not more than 2 ml (preferably zero) per liter.

In case of carrying out reversal development, color development is generally preceded by black-and-white development. A black-and-white developing solution to be used for black-and-white development contains one or more of known black-and-white developing agents, such as dihydroxybenzenes (e.g., hydroquinone), 3-pyrazolidones (e.g., 1-phenyl-3-pyrazolidone), and aminophenols (e.g., N-methyl-p-aminophenol).

The color or black-and-white developing solution generally has a pH between 9 and 12. A rate of replenishment for these developing solutions, though varying depending on the kind of color photographic material to be processed, is usually not more than 3 l per $m^2$ of light-sensitive materials. The rate of replenishment can be reduced to 500 ml/$m^2$ or less by reducing a bromide ion concentration in the replenisher. In particular, when a high silver chloride light-sensitive material is processed, it is preferable to set a bromide ion concentration low and a chloride ion concentration relatively high, by which excellent photographic performance and processing performance can be obtained while suppressing variation in photographic properties. This being the case, the rate of replenishment can be decreased to about 20 ml/$m^2$ at which a color developing tank substantially no more overflows. Where a rate of replenishment is reduced, it is desirable to prevent evaporation and aerial oxidation of a processing solution by minimizing a contact area of the processing solution with air. A rate of replenishment may also be reduced by controlling accumulation of a bromide ion in the developing solution.

The color developing solution has a processing temperature of from 20° to 50° C., and preferably from 30° to 45° C. A processing time with the color developing solution is from 20 seconds to 5 minutes, and preferably from 30 seconds to 3 minutes. The processing time may be shortened by conducting development processing at an elevated temperature and an increased pH in an increased concentration of the color developing agent.

The photographic emulsion layers after color development is usually subjected to bleaching. Bleaching agents to be used include compounds of polyvalent metals (e.g., iron (III), cobalt (III), chromium (IV), copper (II)), peracids, quinones, and nitro compounds. Typical bleaching agents include ferricyanides; bichromates; organic complex salts of iron (III) or cobalt (III), e.g., complex salts with aminopolycarboxylic acids (e.g., ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid) or organic acids (e.g., citric acid, tartaric acid, and malic acid); persulfates; bromates; permanganates; and nitrobenzenes. Preferred of them are aminopolycarboxylic acid iron (III) complexes, e.g., (ethylenediaminetetraacetato)iron (III) salts, and persulfates from the standpoint of rapidness of processing and prevention of environmental pollution. Aminopolycarboxylic acid iron (III) complex salts are particularly useful either in a bleaching bath or in a bleach-fix monobath. In particular, (1,3-diaminopropane-tetraacetato)iron (III) complex salts are favorable bleaching agents for a bleaching bath for negative light-sensitive materials for photography from the standpoint of bleaching ability. A bleaching bath or bleach-fix bath containing these aminopolycarboxylic acid iron (III) complex salts usually has a pH between 5.5 and 8. A lower pH is also employed for rapid processing.

If desired, a fixing bath, a bleach-fix bath, or a prebath thereof may contain known bleaching accelerators. Useful bleaching accelerators include compounds having a mercapto group or a disulfide group as described in U.S. Pat. No. 3,893,858, German Patents. 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and RD, No. 17129 (July, 1978); thiazolidine derivatives as described in JP-A-50-140129; thiourea derivatives as described in JP-B-45-8506, JP-A-52-20832, JP-A-53-32735, and U.S. Pat. No. 3,706,561; iodides as described in German Patent 1,127,715 and JP-A-58-16235; polyoxyethylene compounds as described in German Patents 966,410 and 2,748,430; polyamine compounds described in JP-B-45-8836; compounds described in JP-A-49-42434, JP-A-49-59644, JP-A-53-94927, JP-A-54-35727, JP-A-55-26506, and JP-A-58-163940; and bromide ion. Among them, compounds having a mercapto group or a disulfide group are preferred because of their high accelerating effect. The compounds disclosed in U.S. Pat. No. 3,893,858, West German Patent 1,290,812, and JP-A-53-95630 are particularly preferred. In addition, the compounds disclosed in U.S. Pat. No. 4,552,834 are also preferred. These bleaching accelerators may be incorporated into a light-sensitive material.

The fixing bath may contain known additives, such as a re-halogenating agent, e.g., ammonium bromide and ammonium chloride, a pH buffering agent, e.g., ammonium nitrate, and a metallic corrosion inhibitor, e.g., ammonium sulfate.

The compounds according to the present invention can be used in combination with known fixing agents, such as thiosulfates, thiocyanates, thioether compounds, thioureas, and a large quantity of an iodide, with thiosulfates being commonly employed. In particular, ammonium thiosulfate is preferably used with or without other known fixing agents in view of its solubility and rate of fixing achieved. Preservatives for the bleach-fix bath or fixing bath preferably include sulfites, bisulfites, carbonyl-bisulfite adducts, and sulfinic acid compounds. The fixing bath preferably contains aminopolycarboxylic acid or organophosphonic acid chelating agents (especially 1-hydroxyethylidene-1,1-diphosphonic acid and N,N,N',N'-ethylenediaminetetraphosphonic acid) for improving stability.

The fixing bath can further contain various fluorescent brightening agents, defoaming agents, surface active agents, polyvinylpyrrolidone, methanol, etc.

From the viewpoint of reduction in desilvering time, it is desirable that each processing solution in desilvering should be kept under fortified stirring. Methods or means for achieving fortified stirring include a method in which a jet stream of a processing solution is made to strike against the surface of an emulsion layer as described in JP-A-62-183460 and JP-A-62-183461. The striking is preferably effected within 15 seconds from the time when a light-sensitive material is introduced into the processing solution. A cross-over time between a color developing tank and a bleaching bath (i.e., a time required for a light-sensitive material taken out of a color developing solution to be conveyed to a bleaching solution) is preferably within 10 seconds so as to prevent bleach fog or contamination of the surface of a light-sensitive material. A cross-over time between a bleaching bath and a processing bath having fixing ability is preferably within 10 seconds so as to prevent insufficient cyan color reproduction.

A rate of replenishment for a bleaching bath is preferably not more than 800 ml/m$^2$ in the case of processing color light-sensitive materials for photography having a silver coverage, for example, of from 4 to 12 g/m$^2$.

The silver .halide color photographic material after desilvering is generally subjected to washing and/or stabilization.

The amount of washing water to be used in the washing step is selected from a broad range depending on characteristics of the light-sensitive material (e.g., the kind of photographic materials such as couplers), the end use of the light-sensitive material, the temperature of washing water, the number of washing tanks (the number of stages), the replenishing system (e.g., counter-flow system or direct-flow system), and other various conditions. For example, a relation between the number of washing tanks and the quantity of water in a multi-stage counter-flow system can be obtained by the method described in *Journal of the Society of Motion Picture and Television Engineers*, Vol. 64, pp. 248–253 (May, 1955).

According to the multi-stage counter-flow system, a requisite amount of water can be greatly reduced, and the effects of the present invention are markedly manifested. On the other hand, bacteria tend to grow in the tank with an increase in water retention time, and suspended bacterial cells adhere to light-sensitive materials. Such a problem can be effectively coped with by adopting a method of reducing calcium and magnesium ions of washing water as described in JP-A-62-288838. It is also effective to use bactericides, such as isothiazolone compounds or thiabendazole compounds as described in JP-A-57-8542; chlorine type bactericides, e.g., chlorinated sodium isocyanurate; benzotriazoles; and other bactericides described in Hiroshi Horiguchi, *Bokin bobaizai no kaqaku*, Sankyo Shuppan (1986), Eisei Gijutsukai (ed.), *Biseibutsu no mekkin, sakkin, bobai qijutsu*, Kogyo Gijutsukai (1982), and Nippon Bokin Bobai Gakkai (ed.), *Bokin bobaizai jiten* (1986).

Washing water has a pH usually between 4 and 9, and preferably between 5 and 8. Washing conditions, though varying depending on the characteristics or the end use of the light-sensitive material, and the like, are usually from 15° to 45° C. in temperature and from 20 seconds to 10 minutes in time, and preferably from 25° to 40° C. in temperature and from 30 seconds to 5 minutes in time.

The washing step may be followed by or replaced with stabilization processing. Where stabilization is conducted in place of washing, any of known stabilizing techniques described, e.g., in JP-A-57-8543, JP-A-58-14834, and JP-A-60-220345 can be utilized. Where washing is followed by stabilization, a stabilizing bath to be used includes a solution containing a dye stabilizer, e.g., formalin, hexamethylenetetramine, hexahydrotriazine, and N-methylol compounds, which is used as a final bath for color light-sensitive materials for photography. This stabilizing bath may also contain, if desired, ammonium compounds, metallic compounds (e.g., Bi or Al compounds), fluorescent brightening agents, various chelating agents, film pH-adjusting agents, hardening agents, bactericides, antifungals, alkanolamines, surface active agents (preferably silicone type), and the like. Water which can be used for washing and/or stabilization preferably includes tap water and, in addition, deionized water having Ca ion and Mg ion each reduced to 5 mg/l or less by a treatment with an ion-exchange resin, and water sterilized by a halogen germicidal lamp, a ultraviolet germicidal lamp, etc.

A rate of replenishment for the washing bath and/or stabilizing bath is from 1 to 50 times, preferably from 2 to 30 times, and more preferably from 2 to 15 times, the amount of the prebath which is carried over into the washing bath and/or stabilizing bath per unit area of a light-sensitive material. An overflow accompanying replenishment may be reused in other processing steps, such as a desilvering step.

For the purpose of simplifying and speeding up processing, the silver halide color photographic material may contain therein a color developing agent, preferably in the form of a precursor thereof. Examples of color developing agent precursors include indoaniline compounds described in U.S. Pat. No. 3,342,597, Schiff base compounds described in U.S. Pat. No. 3,342,599, RD No. 14850, RD No. 15159, aldol compounds described in RD No. 13924, metal complex salts described in U.S. Pat. No. 3,719,492, and urethane compounds described in JP-A-53-135628.

If desired, the silver halide color photographic material may further contain therein various 1-phenyl-3-pyrazolidone compounds for the purpose of accelerating color development. Typical examples of these accelerators are described in JP-A-56-64339, JP-A-57-144547, and JP-A-58-115438.

Each of the above-described processing solutions is used at a temperature of from 10° to 50° C. and, in a standard manner, from 33° to 38° C. Higher processing temperatures may be employed for reducing processing time, or lower temperatures may be employed for improving image quality or stability of the processing solution. Further, cobalt intensification or hydrogen peroxide intensification as described in West German Patent No. 2,226,770 and U.S. Pat. No. 3,674,499 may be performed for a saving in silver amount to be used in light-sensitive materials.

As an illustration of the method according to the present invention, processing of a direct positive type silver halide color photographic material is described below.

In one of preferred embodiments of processing, an imagewise exposed silver halide color photographic material is subjected to color development with a surface developing solution containing an aromatic primary amine color developing agent at a pH of 11.5 or lower, particularly between 11.0 and 10.0, either after or simultaneously with fogging by light or a nucleating agent, followed by bleaching and fixing to form a direct positive color image.

Fogging in this embodiment may be effected by either a method called light fogging in which the entire surface of a light-sensitive layer is subjected to second exposure or a method called chemical fogging in which a light-sensitive material is developed in the presence of a nucleating agent. Development may be conducted in the presence of both a nucleating agent and fogging light. Further, a light-sensitive material containing a nucleating agent may be subjected to fogging exposure.

Details of the light fogging method and useful nucleating agents are described in Japanese Patent Application No. Sho-61-253716 which corresponds to JP-A-63-108336 or EP 267482A. Preferred nucleating agents are those represented by formulae (N-I) and (N-II) shown in the above reference. Of these compounds, Compound Nos. (N-I-1) to (N-I-10) and (N-II-1) to (N-II-12) are more preferred.

Further, nucleation accelerators which can be used in the present invention are also described in the above reference. Preferred nucleation accelerators are Compound Nos. (A-1) to (A-13) shown therein.

Details of a color developing solution which can be used in the present invention are described in the above-cited reference. Examples of preferred aromatic primary amine color developing agents include p-phenylenediamine compounds. Typical examples thereof are 3-methyl-4-amino-N-ethyl-(β-methanesulfonamidoethyl)aniline, 3-methyl-4-amino-N-ethyl-N-(β-hydroxyethyl)aniline, 3-methyl-4-amino-N-ethyl-N-methoxyethylaniline, and salts thereof, e.g., sulfates, and hydrochlorides.

Silver halide black-and-white photographic materials and processing thereof according to the present invention will be described below.

Photographic silver halide emulsions which can be used in the black-and-white photographic materials may have any halogen composition, such as silver chloride, silver chlorobromide, silver iodobromide, silver bromide, and silver iodobromochloride. A silver iodide content is preferably not more than 10 mol %, and more preferably not more than 5 mol %.

Silver halide grains in the emulsion may have a relatively broad size distribution but preferably have a narrow size distribution. It is particularly preferred that 90% of the weight or number of grains have a size falling within a range of ±40% of the mean grain size.

In the case where a black-and-white light-sensitive material is used for formation of a negative image of high contrast, fine silver halide grains (e.g., having a mean grain size of 0.7 μm or less) are preferred. A particularly preferred mean grain size is 0.5 μm or less. Grain size distribution is not essentially limited, but a mono-dispersion is preferred. The terminology "mono-dispersion" as used herein means a dispersion in which at least 95% of the weight or number of grains have a size falling within a range of ±40% of the mean grain size.

Silver halide grains in photographic emulsions may have a regular crystal form, such as a cubic form, an octahedral form, a rhombic dodecahedral form, and tetradecahedral form, or an irregular crystal form, such as a spherical form and a plate-like form, or a composite form of these crystal forms.

Individual silver halide grains may have a uniform phase or different phases between the inside and the surface layer thereof.

During silver halide grain formation or physical ripening of grains, a cadmium salt, a sulfite salt, a lead salt, a thallium salt, a rhodium salt or a complex thereof, an iridium salt or a complex thereof, etc. may be present in the system.

Silver halide grains which are preferably used in black-and-white photographic materials are silver haloiodide grains which are prepared in the presence of an iridium salt or a complex thereof in an amount of from $1\times10^{-8}$ to $1\times10^{-5}$ mol per mol of silver and which have a higher silver iodide content on the surface thereof than the grain average silver iodide content. Use of an emulsion containing such a silver haloiodide secures high sensitivity and high gamma.

The silver halide emulsion may or may not be chemically sensitized. Chemical sensitization of silver halide emulsions is carried out by any of known techniques, such as sulfur sensitization, reduction sensitization, and noble metal sensitization, either alone or in combination thereof.

Among the noble metal sensitization techniques, typical is gold sensitization using a gold compound, usually a gold complex. Complexes of noble metals other than gold, e.g., platinum, palladium and rhodium, may also be employed. Specific examples of these noble metal compounds are described in U.S. Pat. No. 2,448,060 and British Patent 618,016. Sulfur sensitization is effected by using a sulfur compound contained in gelatin as well as various sulfur compounds, e.g., thiosulfates, thioureas, thiazoles, and rhodanines.

It is preferable to use an iridium salt or a rhodium salt before completion of physical ripening of silver halide grains, particularly at the time of grain formation.

From the standpoint of obtaining an increased maximum density ($D_{max}$), a silver halide emulsion layer of the light-sensitive material preferably contains two mono-dispersed emulsions differing in mean grain size as taught in JP-A-61-223734 and JP-A-62-90646. In this case, the mono-dispersed grains of smaller size is preferably chemically sensitized, more preferably sulfur sensitized. The mono-dispersed grains of larger size may or may not be chemically sensitized. In general, since larger mono-dispersed grains are tend to cause black pepper when chemically sensitized, they are not subjected to chemical sensitization. If they are chemically sensitized, it is preferable to conduct chemical sensitization to a light degree so as not to cause black pepper. Light chemical sensitization can be performed by reducing the time or temperature of chemical sensitization or by reducing the amount of a chemical sensitizer to be added as compared with the chemical sensitization of the smaller grains. While difference in sensitivity between the larger size mono-dispersed emulsion and the smaller size mono-dispersed emulsion is not particularly limited, it is preferable that the former has higher sensitivity by a difference, expressed in terms of $\Delta \log E$, of from 0.1 to 1.0, and more preferably from 0.2 to 0.7. The mean grain size of the smaller mono-dispersed grains is not more than 90%, preferably not more than 80%, of that of the larger mono-dispersed grains. A mean grain size of the silver halide emulsion grains preferably ranges from 0.02 to 1.0 $\mu$m, and more preferably from 0.1 to 0.5 $\mu$m, and the mean grain size of each of the larger grains and the smaller grains is preferably within this range.

Where two or more emulsions differing in grain size are employed, the smaller size mono-dispersed emulsion is preferably coated to a silver coverage of from 40 to 90% by weight, more preferably from 50 to 80% by weight, based on the total silver coverage.

The mono-dispersed emulsions having different grain sizes may be incorporated into the same layer or separate layers. In the latter case, it is preferable to incorporate the larger size emulsion into an upper layer, and the smaller size emulsion into a lower layer.

The total silver coverage preferably ranges from 1 to 8 g per $m^2$.

For the purpose of increasing sensitivity, sensitizing dyes (e.g., cyanine dyes and merocyanine dyes) described in JP-A-55-52050 can be incorporated into an emulsion layer of the light-sensitive material. The sensitizing dyes may be used either individually or in combination of two or more thereof. A combination of sensitizing dyes is frequently used for the purpose of supersensitization. The emulsion may also contain, in addition to the sensitizing dye, a dye or a substance which has no spectral sensitization activity per se or does not substantially absorb visible light but which exhibits supersensitization activity. Examples of useful sensitizing dyes, combinations of sensitizing dyes for supersensitization, and substances exhibiting supersensitization activity are described in *Research Disclosure*, Vol. 176, No. 17643, p. 23, IV-J (December, 1978).

For prevention of fog during preparation, preservation or photographic processing of the light-sensitive material or for stabilization of photographic properties, various compounds can be introduced into the light-sensitive material of the present invention. Such compounds include azoles, such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, and nitrobenzotriazoles; mercaptopyrimidines; mercaptotriazines; thioketo compounds, such as oxazolinethione; azaindenes, such as triazaindenes, tetraazaindenes (especially 4-hydroxy-substituted (1,3,3*a*,7)-tetraazaindenes), and pentaazaindenes; benzenethiosulfonic acids, benzenesulfinic acids, benzenesulfonic acid amides, and many other compounds known as antifoggants or stabilizers. Preferred of them are benzotriazoles (e.g., 5-methylbenzotriazole) and nitroindazoles (e.g., 5-nitroindazole). If desired, these compounds may be incorporated into processing solutions.

Photographic emulsion layers or other hydrophilic colloidal layers may contain a nucleating agent. Examples of suitable nucleating agents include the compounds disclosed in *Research Disclosure*, Item 23516, p. 346 (November, 1983) and references cited therein, U.S. Pat. Nos. 4,080,207, 4,269,929, 4,276,364, 4,278,748, 4,385,108, 4,459,347, 4,560,638, and 4,478,928, British Patent 2,011,391B, JP-A-60-179734, JP-A-62-270948, JP-A-63-29751, JP-A-61-170733, JP-A-61-270744, JP-A-62-948, EP 217,310, U.S. Pat. No. 4,686,167, JP-A-62-178246, JP-A-63-32538, JP-A-63-104047, JP-A-63-121838,JP-A-63-129337, JP-A-63-223744, JP-A-63-234244, JP-A-63-234245, JP-A-63-234246, JP-A-63-294552, JP-A-63-306438, JP-A-1-100530, JP-A-1-105941, JP-A-1-105943, JP-A-64-10233, JP-A-1-90439, JP-A-1-276128, JP-A-1-283548, JP-A-1-280747, JP-A-1-283549, JP-A-1-285940, JP-A-2-2541, JP-A-2-77057, JP-A-2-139538, JP-A-2-198440, JP-A-2-198441, JP-A-2-198442, JP-A-2-196234, JP-A-2-196235, JP-A-2-220042, JP-A-2-221953 and JP-A-2-221959 and Japanese Patent Application Nos. 1-123693, and 1-126284.

Examples of accelerators of development or nucleation infectious development which can be suitably used in the present invention include the compounds disclosed in JP-A-53-77616, JP-A-54-37732, JP-A-53-137133, JP-A-60-140340, and JP-A-60-14959 as well as various compounds containing a nitrogen or sulfur atom.

These accelerators are used in an amount usually of from $1.0\times10^{-3}$ to 0.5 g/$m^2$, and preferably from $5.0\times10^{-3}$ to 0.1 g/$m^2$, although the optimum amount varies depending on the kind of the compound.

Photographic emulsion layers or other hydrophilic colloidal layers of the light-sensitive material may contain a desensitizer.

An organic desensitizer which can be used in the present invention is specified by its polarographic half wave potential, i.e., an oxidation-reduction potential determined by polarography. That is, it is specified to have a positive sum of a polarographic anode potential and a polarographic cathode potential. Determination of the oxidation-reduction potential by polarography is described, e.g., in U.S. Pat. No. 3,501,307. Organic desensitizers containing at least one water-soluble group, e.g., a sulfo group and a carboxyl group, are preferred. The water-soluble group may be in the form of a salt with an organic base, e.g., ammonia, pyridine, triethylamine, piperidine, and morpholine, or an alkali metal, e.g., sodium and potassium.

Preferred as organic desensitizers are those described in JP-A-63-133145 (the compounds represented by formulae (III) to (V)).

The organic desensitizer is added to a silver halide emulsion in an amount usually of from $1.0\times10^{-8}$ to $1.0\times10^{-4}$ mol/$m^2$, and preferably of from $1.0\times10^{-7}$ to $1.0\times10^{-5}$ mol/$m^2$.

The emulsion layers or other hydrophilic colloidal layers may contain a water-soluble dye as a filter dye or for the purpose of preventing irradiation or other various purposes. Filter dyes to be used are dyes for reducing photographic sensitivity, preferably ultraviolet absorbents having a spectral absorption maximum in the intrinsic sensitivity region of silver halide and dyes showing substantial light absorption in the region chiefly in the range of from 380 to 600 nm which are used for improving safety against safelight in handling light-sensitive materials for bright room.

These dyes are added to an emulsion layer according to the purpose, or preferably added to a light-insensitive hydrophilic colloidal layer above a silver halide emulsion layer, i.e., farther from a support than the silver halide emulsion layer together with a mordant for fixing.

The ultraviolet absorbent is usually added in an amount of from $1\times10^{-2}$ to 1 g/m$^2$, and preferably from 50 to 500 mg/m$^2$, though varying depending on its molar extinction coefficient.

The ultraviolet absorbent can be incorporated into a coating composition in the form of a solution in an appropriate solvent, e.g., water, an alcohol (e.g., methanol, ethanol and propanol), acetone, methyl cellosolve, or a mixture thereof.

Useful ultraviolet absorbents include aryl-substituted benzotriazole compounds, 4-thiazolidone compounds, benzophenone compounds, cinnamic ester compounds, butadiene compounds, benzoxazole compounds, and ultraviolet absorbing polymers.

Specific examples of these ultraviolet absorbents are described in U.S. Pat. Nos. 3,533,794, 3,314,794, and 3,352,681, JP-A-46-2784, U.S. Pat. Nos. 3,705,805, 3,707,375, 4,045,229, 3,700,455, and 3,499,762, and West German Patent Publication 1,547,863.

Filter dyes which can be used include oxonol dyes, hemioxonol dyes, styryl dyes, merocyanine dyes, cyanine dyes, and azo dyes. From the viewpoint of minimizing color remaining after development processing, water-soluble dyes or dyes which are discolored with an alkali or a sulfite ion are preferred.

Specific examples of suitable filter dyes include pyrazolone oxonol dyes described in U.S. Pat. No. 2,274,782, diarylazo dyes described in U.S. Pat. No. 2,956,879, styryl dyes and butadienyl dyes described in U.S. Pat. Nos. 3,423,207 and 3,384,487, merocyanine dyes described in U.S. Pat. No. 2,527,583, merocyanine dyes and oxonol dyes described in U.S. Pat. Nos. 3,486,897, 3,652,284, and 3,718,472, enaminohemioxonol dyes described in U.S. Pat. No. 3,976,661, and dyes described in British Pat. Nos. 584,609 and 1,177,429, JP-A-48-85130, JP-A-49-99620, JP-A-49-114420, and U.S. Pat. Nos. 2,533,472, 3,148,187, 3,177,078, 3,247,127, 3,540,887, 3,575,704, and 3,653,905.

These dyes are added to a coating composition for a light-insensitive hydrophilic colloidal layer in the form of a solution in an appropriate solvent, e.g., water, an alcohol (e.g., methanol, ethanol, and propanol), acetone, methyl cellosolve, or a mixture thereof.

A suitable amount of the dye to be added usually ranges from $1\times10^{-3}$ to 1 g/m$^2$ and particularly from $1\times10^{-3}$ to 0.5 g/m$^2$.

Photographic emulsion layers or other hydrophilic colloidal layers may also contain an organic or inorganic hardening agent, such as chromates, aldehydes (e.g., formaldehyde and glutaraldehyde), N-methylol compounds (e.g., dimethylolurea), active vinyl compounds (e.g., 1,3,5-triacryloyl-hexahydro-s-triazine and 1,3-vinylsulfonyl-2-propanol), active halogen compounds (e.g., 2,4-dichloro-6-hydroxy-s-triazine), and mucohalogenic acids, either individually or in combination thereof.

Photographic emulsion layers or other hydrophilic colloidal layers may further contain various surface active agents for the purpose of coating aid, static charge prevention, improvement of slip properties, emulsification and dispersion aid, prevention of blocking, and improvement of photographic characteristics (e.g., acceleration of development, increase of contrast, and increase of sensitivity). Surface active agents which are particularly useful in the present invention are polyalkylene oxides having a molecular weight of 600 or more as disclosed in JP-B-58-9412. For particular use as an antistatic agent, fluorine-containing surface active agents are preferred. For the details of fluorine-containing surface active agents, reference can be made in U.S. Pat. No. 4,201,586, JP-A-60-80849, and JP-A-59-74554.

For the purpose of preventing adhesion, photographic emulsion layers or other hydrophilic colloidal layers may contain a matting agent, such as silica, magnesium oxide, and polymethyl methacrylate.

For the purpose of improving dimensional stability and the like, photographic emulsions can contain a dispersion of a water-insoluble or sparingly water-soluble synthetic polymer. Examples of such a polymer include homopolymers or copolymers of an alkyl (meth)acrylate, an alkoxyalkyl (meth)acrylate, and glycidyl (meth-)acrylate and copolymers comprising these monomers and acrylic acid, methacrylic acid, etc.

Silver halide emulsion layers and other layers of the light-sensitive material preferably contain a compound having an acidic group. Examples of suitable acidic group-containing compounds are organic acids, e.g., salicylic acid, acetic acid, and ascorbic acid; and homopolymers or copolymers comprising an acid monomer, e.g., acrylic acid, maleic acid, and phthalic acid as a repeating unit. With respect to these compounds, reference can be made in JP-A-61-223834, JP-A-61-228437, JP-A-62-25745 and JP-A-62-55642. Preferred of them are ascorbic acid as a low-molecular compound and an aqueous latex of a copolymer comprising an acid monomer (e.g., acrylic acid) and a crosslinking monomer having at least two unsaturated groups (e.g., divinylbenzene) as a high-molecular compound.

A developing solution for developing the above-described silver halide black-and-white light-sensitive materials contains generally employed additives, such as a developing agent, an alkali agent, a pH buffering agent, a preservative, and a chelating agent. Processing can be achieved by any of known processing methods with any of known processing solutions. The processing temperature is usually selected from 18° to 50° C. Temperatures lower than 18° C. or higher than 50° C. are also employable.

One or more of known developing agents for black-and-white developing solution, e.g., dihydroxybenzenes, 1-phenyl-3-pyrazolidones, and aminophenols, can be used.

Examples of dihydroxybenzene developing agents are hydroquinone, chlorohydroquinone, bromohydroquinone, isopropylhydroquinone, methylhydroquinone, 2,3-dichlorohydroquinone, 2,3-dibromohydroquinone, and 2,5-dimethylhydroquinone, with hydroquinone being preferred.

Examples of 1-phenyl-3-pyrazolidone and its derivatives serving as an auxiliary developing agent are 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl- 4,4-dimethyl-3-pyrazolidone, and 1-p-tolyl-4,4-dimethyl-3-pyrazolidone.

Examples of p-aminophenol auxiliary developing agents are N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol, with N-methyl-p-aminophenol being preferred.

Dihydroxybenzene developing agents are usually used in a concentration of from 0.05 to 0.8 mol/l. Where a dihydroxybenzene developing agent and a 1-phenyl-3-pyrazolidone or p-aminophenol auxiliary developing agent are used in combination, the former is preferably used in a concentration of from 0.05 to 0.5 mol/l, and the latter not more than 0.06 mol/l.

Sulfite preservatives which can be used in the black-and-white developing solution include sodium sulfite, potassium sulfite, lithium sulfite, sodium bisulfite, potassium metabisulfite, and formaldehyde-sodium bisulfite.

The sulfite preservative is usually added to a black-and-white developing solution, and particularly a developing solution for graphic arts in a concentration of 0.3 mol/l or more. Since too a high sulfite concentration induces precipitation in the developing solution to cause contamination, the upper limit of the sulfite concentration is preferably 1.2 mol/l.

Alkali agents which can be used in the developing solution include sodium hydroxide, potassium hydroxide, sodium carbonate, potassium carbonate, sodium tertiary phosphate, potassium tertiary phosphate, sodium silicate, and potassium silicate, which function as pH adjusting agents or buffering agents.

Other additives for a black-and-white developing solution include boric acid; borax; development inhibitors, e.g., sodium bromide, potassium bromide, and potassium iodide; organic solvents, e.g., ethylene glycol, diethylene glycol, triethylene glycol, dimethylformamide, methyl cellosolve, hexylene glycol, ethanol, and methanol; and antifoggants or black pepper inhibitors, such as mercapto compounds (e.g., 1-phenyl-5-mercaptotetrazole and sodium 2-mercaptobenzimidazole-5-sulfonate), indazole compounds (e.g., 5-nitroindazole), and benzotriazole compounds (e.g., 5-methylbenzotriazole). If desired, the developing solution may further contain toning agents, surface active agents, defoaming agents, hard water softeners, hardening agents, and so on.

The developer may contain the compound disclosed in JP-A-56-24347 as a silver stain inhibitor, the compound disclosed in JP-A-62-212651 as an agent for preventing uneven development, and the compound disclosed in JP-A-61-267759 as a dissolving aid.

Buffering agents which can be used in the developing solution include boric acid as described in JP-A-62-186259; and saccharides (e.g., saccharose), oximes (e.g., acetoxime), phenols (e.g., 5-sulfosalicylic acid) and tertiary phosphates (e.g., sodium tertiary phosphate and potassium tertiary phosphate) as described in JP-A-60-93433.

A fixing bath which can be used for black-and-white light-sensitive materials is an aqueous solution containing a fixing agent and, if desired, a hardening agent (e.g., water-soluble aluminum compounds), acetic acid, and a dibasic acid (e.g., tartaric acid, citric acid, and a salt thereof) and preferably having a pH of 3.8 or higher, and more preferably between 4.0 and 7.5.

The compound according to the present invention acting as a fixing agent may be used in combination with other known fixing agents, such as sodium thiosulfate and ammonium thiosulfate. Ammonium thiosulfate is particularly preferred from the standpoint of fixing rate. The amount of fixing agents is subject to variation and is usually selected from about 0.1 to about 5 mol/l. Water-soluble aluminum salts functioning as a hardening agent are generally known as a hardening agent for an acid hardening fixer and include, for example, aluminum chloride, aluminum sulfate, and potash alum.

Dibasic acids which can be used in the fixing bath include tartaric acid and its derivatives, and citric acid and its derivatives. Specific examples are tartaric acid, potassium tartrate, sodium tartrate, sodium potassium-tartrate, ammonium tartrate, potassium ammonium tartrate, citric acid, sodium citrate, and potassium citrate. These dibasic acids may be used either individually or in combination of two or more thereof. An effective amount of the dibasic acids in the fixing bath is at least 0,005 mol/l, and particularly from 0.01 to 0.03 mol/l.

If desired, the fixing bath may further contain a preservative (e.g., sulfites, bisulfites), a pH buffering agent (e.g., acetic acid, boric acid), a pH adjusting agent (e.g., ammonia, sulfuric acid), an image stabilizer (e.g., potassium iodide), and a chelating agent. On an account of a high pH of the developing solution, the pH buffering agent is used in the fixing bath in a concentration of from about 10 to 40 g/l, and preferably from about 18 to 25 g/l.

The time and temperature conditions of fixing are similar to development, and a temperature of from about 20° C. to about 50° C. and a time of from 10 seconds to 1 minute are preferred. The rate of replenishment for the fixing bath is preferably not more than 400 ml/m$^2$.

Washing water to be used for a washing step may contain an antifungal agent (e.g., compounds described in Horiguchi, *Bokin Bobai no Kagaku* and compounds described in JP-A-62-115154), a washing accelerator (e.g., sulfites), and a chelating agent.

The rate of replenishment for washing water (or a stabilizing bath) may be 1200 ml/m$^2$ or less, inclusive 0 ml/m$^2$ (no replenishment). With no replenishment, washing is carried out in a so-called water displacement washing system. The rate of replenishment can be reduced by using a conventionally known multi-stage counter flow system using, for example, two or three stages.

Problems associated with a reduction of a rate of replenishment for washing water or a stabilizing solution can be coped with by appropriately combining the following techniques.

A washing bath or a stabilizing bath can contain microbiocides, such as isothiazoline compounds described in R. T. Kreiman, *J. Image, Tech.*, Vol. 10, No. 6, p. 242 (1984), isothiazoline compounds described in RD, Vol. 205, No. 20526 (May, 1981), isothiazoline compounds disclosed in RD, Vol. 228, No. 22845 (April, 1983), and the compounds described in JP-A-61-115154 and JP-A-62-209532. Compounds described in Hiroshi Horiguchi, *Bokin Bobai no Kagaku*, Sankyo Shuppan (1982); Nippon Bokin Bobai Gakkai (ed.), *Bokin Bobai Gijutsu Handbook*, Hakuhodo (1986); L. E. West, *Photo Sci & Eng.*, Vol. 9, No. 6, "Water Quality Criteria", (1965); M. W. Beach, *SMPTE Journal*, Vol. 85, "Microbiological Growths in Motion Picture Processing" (1976); and R. O. Deegan, *J. Imaging Tech.*, Vol. 10, No. 6, "Photo Processing Wash Water Biocides" (1984) can also be used.

When washing is carried out with a small amount of water, it is preferable to provide a tank for cleansing squeeze rollers or a cross-over rack as described in JP-A-63-18350 and JP-A-62-287252.

A part or the whole of an overflow from a washing bath or a stabilizing bath resulting from replenishment with water having been rendered antifungal may be utilized as a part of a prebath having fixing ability as described in JP-A-60-235133 and JP-A-63-129343. Further, a water-soluble surface active agent or a defoaming agent may be added to washing water or a stabilizing bath in order to prevent water mark which often occur in washing with a small amount of water and/or to prevent processing components adhered to squeeze rollers from being transferred to a processed film.

For the purpose of preventing contamination with dyes dissolved from a light-sensitive material, a dye adsorbing agent as described in JP-A-63-163456 may be added to a washing tank.

A developed and fixed photographic material is subjected to washing and drying. Washing is carried out to substantially completely remove a silver salt dissolved by fixing. Washing is preferably carried out at a temperature of from about 20° C. to about 50° C. for a period of from 10 seconds to 3 minutes. Drying is usually carried out at a temperature of from about 40° C. to about 100° C. A drying time, though subject to variation according to the environmental condition, usually ranges from about 5 seconds to 3.5 minutes.

A roller conveyor type automatic developing machine is described, e.g., U.S. Pat. Nos. 3,025,779 and 3,545,971. The automatic developing machine of this type is comprised of four steps: development, fixing, washing, and drying. In carrying out the method according to the present invention, these four steps are preferably followed, while not excluding other steps, such as stopping. In the washing step, a counter flow system using 2 or 3 stages allows a saving of water.

A developing solution to be used in this invention is preferably stored in a container having low permeability to oxygen as described in JP-A-61-73147. Replenishment of the developing solution is preferably effected by the system described in JP-A-62-91939.

Silver halide photographic materials which can be processed according to the method of the present invention include not only color light-sensitive materials but general black-and-white light-sensitive materials (e.g., black-and-white light-sensitive materials for photography, black-and-white light-sensitive materials for X-ray photography, and black-and-white light-sensitive materials for printing), infrared-sensitive materials for laser scanners, and the like.

The present invention is now illustrated in greater detail with reference to Examples, but it should be understood that the present invention is not deemed to be limited thereto. All the percents, parts, and ratios are by weight unless otherwise indicated.

EXAMPLE 1

Plural layers having the following compositions were coated on a cellulose triacetate film support having a subbing layer to prepare a multi-layer color light-sensitive material (designated Sample 101).

| | |
|---|---|
| 1st Layer (Anti-halation Layer): | |
| Black colloidal silver | 0.15 g/m$^2$ |
| Gelatin | 1.5 g/m$^2$ |

-continued

| | |
|---|---|
| ExM-8 | 0.08 g/m$^2$ |
| UV-1 | 0.03 g/m$^2$ |
| UV-2 | 0.06 g/m$^2$ |
| Solv-2 | 0.08 g/m$^2$ |
| UV-3 | 0.07 g/m$^2$ |
| Cpd-5 | $6 \times 10^{-4}$ g/m$^2$ |
| 2nd Layer (Intermediate Layer): | |
| Gelatin | 1.5 g/m$^2$ |
| IV-1 | 0.03 g/m$^2$ |
| UV-2 | 0.06 g/m$^2$ |
| UV-3 | 0.07 g/m$^2$ |
| ExF-1 | 0.004 g/m$^2$ |
| Solv-2 | 0.07 g/m$^2$ |
| Cpd-5 | $6 \times 10^{-4}$ g/m$^2$ |
| 3rd Layer (1st Red-Sensitive Emulsion Layer): | |
| Silver iodobromide emulsion (AgI: 2 mol %; inner high AgI type; sphere-equivalent diameter: 0.3 μm; coefficient of variation of sphere-eq. diameter: 29%; normal crystal/twin mixed grains; diameter/thickness ratio: 2.5) | 0.5 g-Ag/m$^2$ |
| Gelatin | 0.8 g/m$^2$ |
| ExS-1 | $1.0 \times 10^{-4}$ mol/mol-AgX (X: halogen) |
| ExS-2 | $3.0 \times 10^{-4}$ mol/mol-AgX |
| ExS-3 | $1 \times 10^{-5}$ mol/mol-AgX |
| ExC-3 | 0.22 g/m$^2$ |
| ExC-4 | 0.02 g/m$^2$ |
| Cpd-5 | $3 \times 10^{-4}$ g/m$^2$ |
| 4th Layer (2nd Red-Sensitive Emulsion Layer): | |
| Silver iodobromide emulsion (AgI: 4 mol %; inner high AgI type; sphere-eq. diameter: 0.55 μm; coefficient of variation of sphere-eq. diameter: 20%; normal crystal/twin mixed grains; diameter/thickness ratio: 1) | 0.7 g-Ag/m$^2$ |
| Gelatin | 1.26 g/m$^2$ |
| ExS-1 | $1 \times 10^{-4}$ mol/mol-AgX |
| ExS-2 | $3 \times 10^{-4}$ mol/mol-AgX |
| ExS-3 | $1 \times 10^{-5}$ mol/mol-AgX |
| ExC-3 | 0.33 g/m$^2$ |
| ExC-4 | 0.01 g/m$^2$ |
| ExY-16 | 0.01 g/m$^2$ |
| ExC-7 | 0.04 g/m$^2$ |
| ExC-2 | 0.08 g/m$^2$ |
| Solv-1 | 0.03 g/m$^2$ |
| Cpd-5 | $5 \times 10^{-4}$ g/m$^2$ |
| 5th Layer (3rd Red-Sensitive Emulsion Layer): | |
| Silver iodobromide emulsion (AgI: 10 mol %; inner high AgI type; sphere-eq. diameter: 0.7 μm; coefficient of variation of sphere-eq. diameter: 30%; twin-mixed grains; diameter/thickness ratio: 2) | 0.7 g-Ag/m$^2$ |
| Gelatin | 0.8 g/m$^2$ |
| ExS-1 | $1 \times 10^{-4}$ mol/mol-Agx |
| ExS-2 | $3 \times 10^{-4}$ mol/mol-AgX |
| ExS-3 | $1 \times 10^{-5}$ mol/mol-Agx |
| ExC-5 | 0.05 g/m$^2$ |
| ExC-6 | 0.06 g/m$^2$ |
| Solv-1 | 0.15 g/m$^2$ |
| Solv-2 | 0.08 g/m$^2$ |
| Cpd-5 | $3 \times 10^{-5}$ g/m$^2$ |
| 6th Layer (Intermediate Layer): | |
| Gelatin | 1.0 g/m$^2$ |
| Cpd-5 | $4 \times 10^{-4}$ g/m$^2$ |
| Cpd-1 | 0.10 g/m$^2$ |
| Cpd-4 | 1.23 g/m$^2$ |
| Solv-1 | 0.05 g/m$^2$ |
| Cpd-3 | 0.25 g/m$^2$ |
| 7th Layer (1st Green-Sensitive Emulsion Layer): | |
| Silver iodobromide emulsion (AgI: 2 mol %; inner high AgI type; sphere-eq. diameter: 0.3 μm; coefficient of variation of sphere-eq. | 0.30 g-Ag/m$^2$ |

-continued

| | |
|---|---|
| diameter: 28%; normal/twin mixed grains; diameter/thickness ratio: 2.5) | |
| Gelatin | 0.4 g/m$^2$ |
| ExS-4 | 5 × 10$^{-4}$ mol/mol-AgX |
| ExS-6 | 0.3 × 10$^{-4}$ mol/mol-AgX |
| ExS-5 | 2 × 10$^{-4}$ mol/mol-AgX |
| ExM-9 | 0.2 g/m$^2$ |
| ExY-14 | 0.03 g/m$^2$ |
| ExM-8 | 0.03 g/m$^2$ |
| Solv-1 | 0.2 g/m$^2$ |
| Cpd-5 | 2 × 10$^{-4}$g/m$^2$ |
| 8th Layer (2nd Green-Sensitive Emulsion Layer): | |
| Silver iodobromide emulsion (AgI: 4 mol %; inner high AgI type; sphere-eq. diameter: 0.55 μm; coefficient of variation of sphere-eq. diameter: 20%; normal/twin mixed grains; diameter/thickness ratio: 4) | 0.6 g-Ag/m$^2$ |
| Gelatin | 0.8 g/m$^2$ |
| ExS-4 | 5 × 10$^{-4}$ mol/mol-AgX |
| ExS-5 | 2 × 10$^{-4}$ mol/mol-AgX |
| ExS-6 | 0.3 × 10$^{-4}$ mol/mol-AgX |
| ExM-9 | 0.25 g/m$^2$ |
| ExM-8 | 0.03 g/m$^2$ |
| ExM-10 | 0.015 g/m$^2$ |
| ExY-14 | 0.04 g/m$^2$ |
| Solv-1 | 0.2 g/m$^2$ |
| Cpd-5 | 3 × 10$^{-4}$ g/m$^2$ |
| 9th Layer (3rd Green-Sensitive Emulsion Layer): | |
| Silver iodobromide emulsion (AgI: 10 mol %, inner high AgI type; sphere-eq. diameter: 0.7 μm; coefficient of variation of sphere-eq. diameter: 30%; normal/twin mixed grains; diameter/thickness ratio: 2.0) | 0.85 g-Ag/m$^2$ |
| Gelatin | 1.0 g/m$^2$ |
| ExS-4 | 2.0 × 10$^{-4}$ mol/mol-AgX |
| ExS-5 | 2.0 × 10$^{-4}$ mol/mol-Agx |
| ExS-6 | 0.2 × 10$^{-4}$ mol/mol-AgX |
| ExS-7 | 3.0 × 10$^{-4}$ mol/mol-AgX |
| ExM-12 | 0.06 g/m$^2$ |
| ExM-13 | 0.02 g/m$^2$ |
| EXM-8 | 0.02 g/m$^2$ |
| Solv-1 | 0.20 g/m$^2$ |
| Solv-2 | 0.05 g/m$^2$ |
| Cpd-5 | 4 × 10$^{-4}$ g/m$^2$ |
| 10th Layer (Yellow Filter Layer): | |
| Gelatin | 0.9 g/m$^2$ |
| Yellow colloidal silver | 0.05 g/m$^2$ |
| Cpd-1 | 0.2 g/m$^2$ |

-continued

| | |
|---|---|
| Solv-1 | 0.15 g/m$^2$ |
| Cpd-5 | 4 × 10$^{-4}$g/m$^2$ |
| 11th Layer (1st Blue-Sensitive Emulsion Layer): | |
| Silver iodobromide emulsion (AgI: 4 mol %; inner high AgI type; sphere-eq. diameter: 0.5 μm; coefficient of variation of sphere-eq. diameter: 15%; octahedral grains) | 0.4 g-Ag/m$^2$ |
| Gelatin | 1.0 g/m$^2$ |
| ExS-8 | 2 × 10$^{-4}$ mol/mol-AgX |
| ExY-16 | 0.9 g/m$^2$ |
| ExY-14 | 0.09 g/m$^2$ |
| Solv-1 | 0.3 g/m$^2$ |
| Cpd-5 | 4 × 10$^{-4}$ g/m$^2$ |
| 12th Layer (2nd Blue-Sensitive Emulsion Layer): | |
| Silver iodobromide emulsion (AgI: 10 mol %, inner high AgI type; sphere-eq. diameter: 1.3 μm; coefficient of variation of sphere-eq. diameter: 25%; normal/twin mixed grains; diameter/thickness ratio: 4.5) | 0.5 g-Ag/m$^2$ |
| Gelatin | 0.6 g/m$^2$ |
| ExS-8 | 1 × 10$^{-4}$ mol/mol-AgX |
| ExY-16 | 0.12 g/m$^2$ |
| Solv-1 | 0.04 g/m$^2$ |
| Cpd-5 | 2 × 10$^{-4}$ g/m$^2$ |
| 13th Layer (1st Protective Layer): | |
| Fine silver iodobromide emulsion (AgI: 1 mol %; mean grain size: 0.07 μm) | 0.2 g-Ag/m$^2$ |
| Gelatin | 0.8 g/m$^2$ |
| UV-3 | 0.1 g/m$^2$ |
| UV-4 | 0.1 g/m$^2$ |
| UV-5 | 0.2 g/m$^2$ |
| Solv-3 | 0.04 g/m$^2$ |
| Cpd-5 | 3 × 10$^{-4}$ g/m2 |
| 14th Layer (2nd Protective Layer): | |
| Gelatin | 0.9 g/m$^2$ |
| Polymethyl methacrylate (particle size: 1.5 μm) | 0.2 g/m$^2$ |
| Cpd-5 | 4 × 10$^{-4}$ g/m$^2$ |
| H-1 | 0.4 g/m$^2$ |

Each layer further contained a surface active agent as a coating aid.

Chemical structures or chemical names of the compounds used in the sample preparation are shown below.

UV-4:

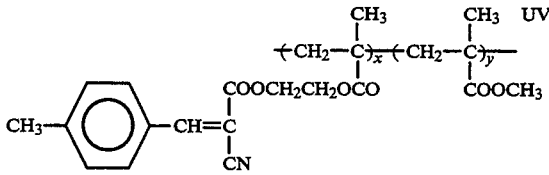

x/y = 7/3 (weight ratio)

UV-5:

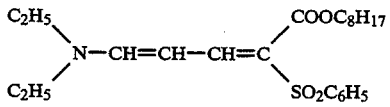

UV-1:

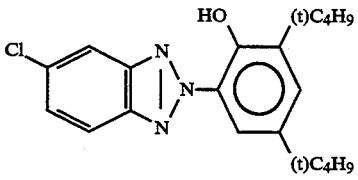

UV-2:

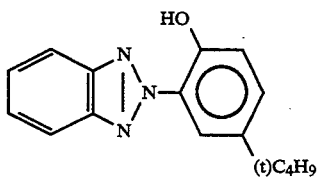

UV-3:

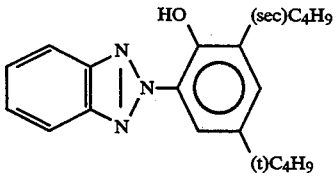

Solv-1: Tricresyl phosphate

-continued
Dibutyl phthalate Solv-2: Bis(2-ethylhexyl) phthalate Solv-3:
ExM-8:
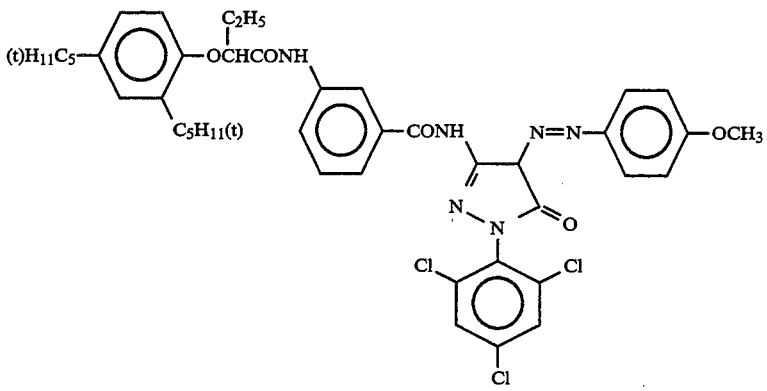
ExF-1:
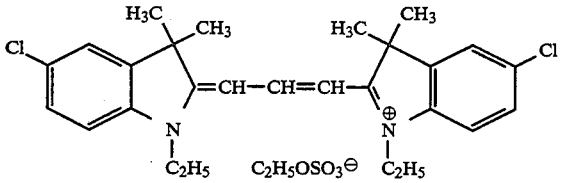
ExC-2:
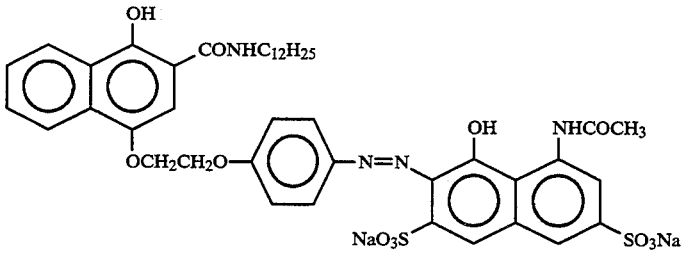
ExC-3:
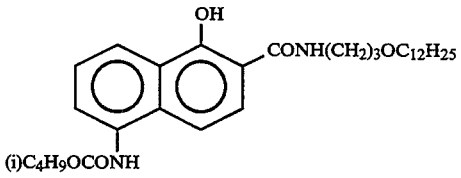
ExY-14:
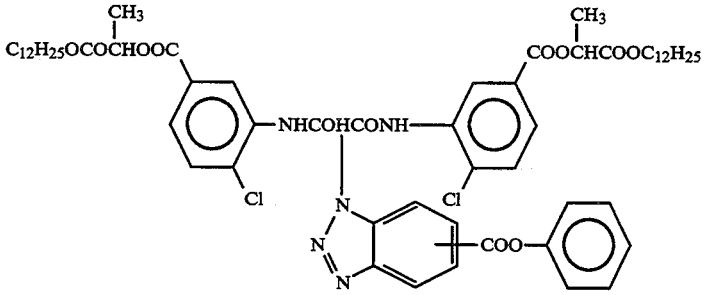

-continued
ExC-4:
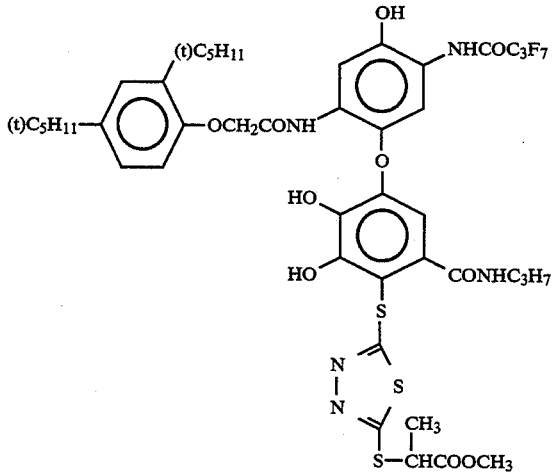
ExY-16:
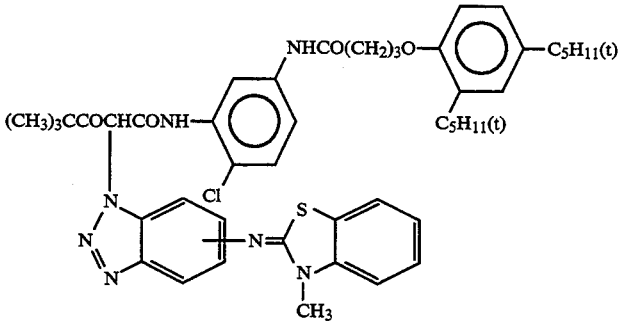
ExC-5:
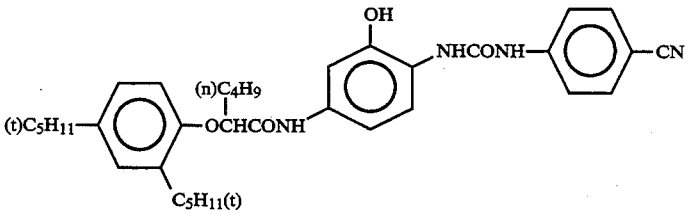
ExC-6:
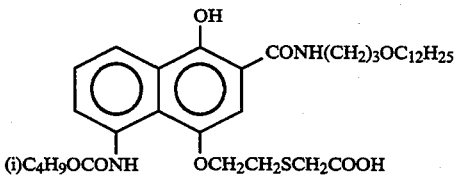
ExC-7:
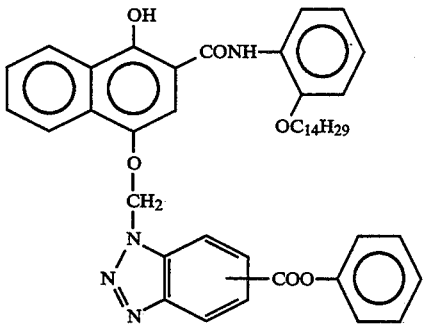

-continued
ExM-9:
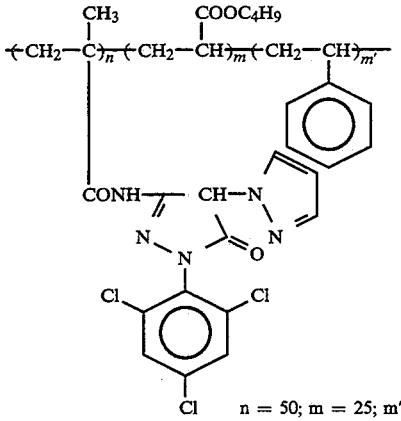
n = 50; m = 25; m' = 25
Mol. Wt.: ca. 20,000
ExM-10:
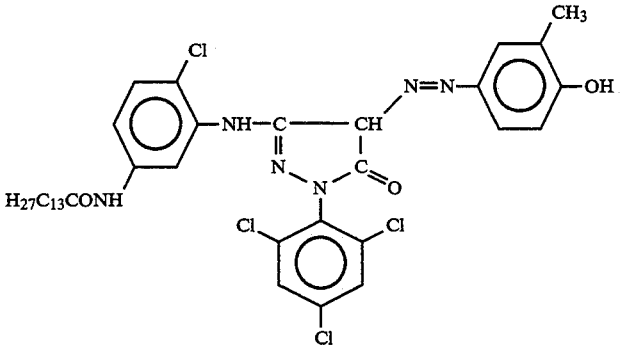
ExM-12:
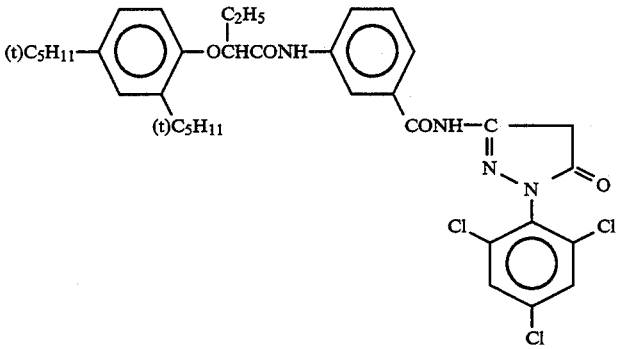
ExM-13:
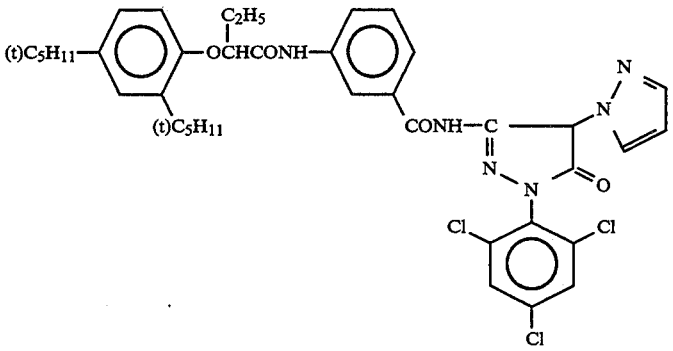

-continued
ExM-16:
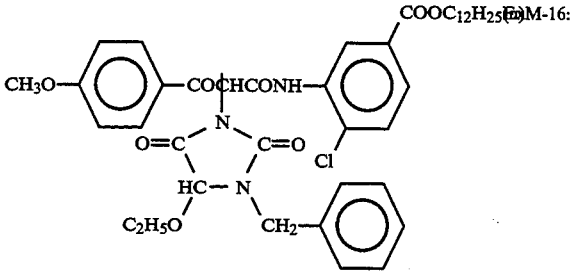
Cpd-1:
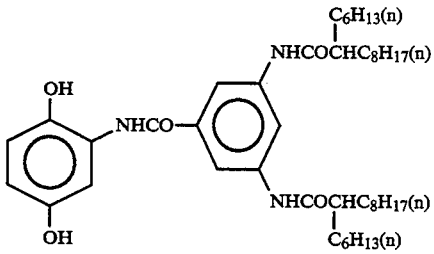
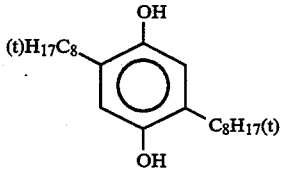
Cpd-2:
ExS-1:
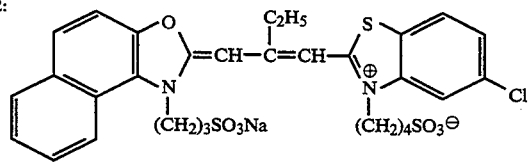
ExS-2:
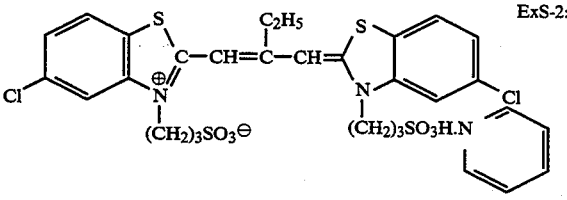
ExS-3:
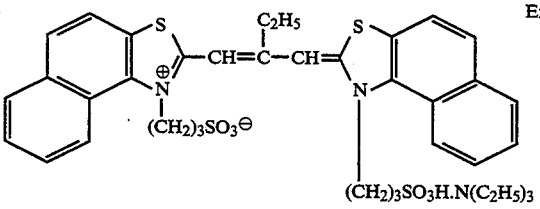
ExS-4:
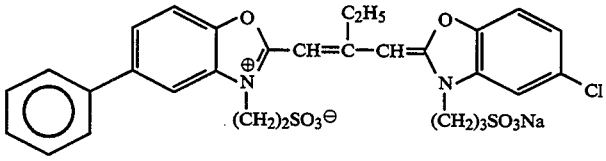
ExS-5:
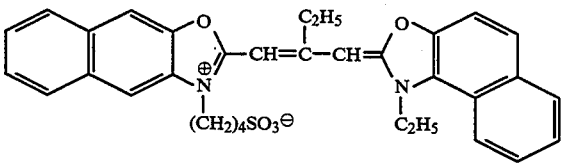
ExS-6:
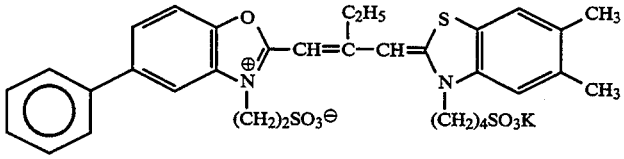
ExC-7:
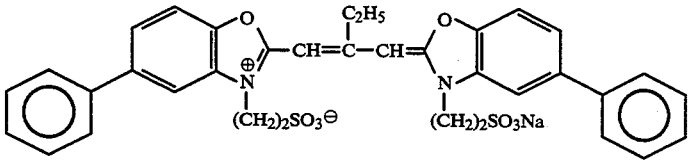
ExS-8:
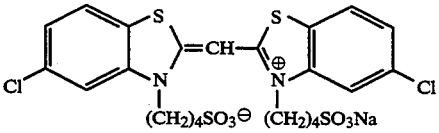
H-1:
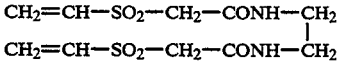

-continued

Cpd-3:

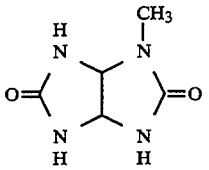

Cpd-4:

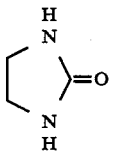

Cpd-5:

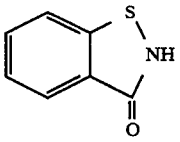

The total coating except for the support and its subbing layer of Sample 101 thus prepared had a dry thickness of 17.6 μm and a rate of swell ($T_{\frac{1}{2}}$) of 8 seconds.

The sample was cut to a width of 35 mm. The strip was exposed to light for imagewise exposure and subjected to running processing using an automatic developing machine according to the following schedule until the cumulative quantity of a replenisher for a fixing bath reached three times the volume of the fixing tank.

| Processing Step | Time | Temp. (°C.) | Rate of Replenishment (ml/m*) | Tank Volume (l) |
|---|---|---|---|---|
| Color development | 3'15" | 38 | 15 | 20 |
| Bleach | 4'30" | 38 | 10 | 40 |
| Washing | 2'10" | 35 | 10 | 20 |
| Fixing | 4'20" | 38 | 30 | 30 |
| Washing (1**) | 1'05" | 35 | — | 10 |
| Washing (2**) | 1'00" | 35 | 20 | 10 |
| Stabilization | 1'05" | 38 | 10 | 10 |
| Drying | 4'20" | 55 | | |

Note:
*Amount of replenisher (ml) per m of 35 mm wide strip
**Counter-flow system of from bath (2) to bath (1)

Each processing solution had the following composition.

| Color Developing Solution: | Running Solution | Replenisher |
|---|---|---|
| Diethylenetriaminepentaacetic acid | 1.0 g | 1.1 g |
| 1-Hydroxyethylidene-1,1-diphosphonic acid | 3.0 g | 3.2 g |
| Sodium sulfite | 4.0 g | 4.9 g |
| Potassium carbonate | 30.0 g | 30.0 g |
| Potassium bromide | 1.4 g | — |
| Potassium iodide | 1.5 mg | — |
| Hydroxylamine sulfate | 2.4 g | 3.6 g |
| 4-(N-Ethyl-N-β-hydroxyethylamino)-2-methylaniline sulfate | 4.5 g | 7.2 g |
| Water to make | 1.0 l | 1.0 l |
| pH | 10.05 | 10.10 |
| Bleaching Bath: | | |
| Ammonium (1,3-diaminopropanetetraacetato)iron (III) monohydrate | 144.0 g | 206.0 g |
| Ammonium bromide | 84.0 g | 120.0 g |
| Ammonium nitrate | 30.0 g | 41.7 g |
| Acetic acid (98%) | 28.0 g | 40.0 g |
| Hydroxyacetic acid | 63.0 g | 90.0 g |
| Water to make | 1.0 l | 1.0 l |
| pH (adjusted with 27% aqueous ammonia) | 3.0 | 2.8 |
| Fixing Bath: | | |
| Disodium ethylenediamine-tetraacetate | 0.5 g | 1.0 g |
| Sodium sulfite | 7.0 g | 12.0 g |
| Sodium bisulfite | 5.0 g | 9.5 g |
| Fixing agent (a) or (b): | | |
| (a) Ammonium thiosulfate aqueous solution (70%) | 170.0 ml | 240.0 ml |
| (b) Fixing agent of Table 1 below | 0.8 mol | 1.1 mol |
| Water to make | 1.0 l | 1.0 l |
| pH | 6.7 | 6.7 |

Washing Water:
(Running solution = replenisher)

Tap water was passed through a mixed bed column packed with an H type strongly acidic cation-exchange resin ("Amberlite IR-120B" produced by Rohm & Haas Co.) and an OH type anion-exchange resin ("Amberlite IRA-400" produced by Rohm & Haas) to decrease calcium and magnesium ions each to 3 mg/l or less. To the deionized water were added 20 mg/l of dichlorinated sodium isocyanurate and 150 mg/l of sodium sulfate. The resulting washing water had a pH between 6.5 and 7.5.

| Stabilizing Bath: | Running Solution | Replenisher |
|---|---|---|
| Formalin (37%) | 2.0 ml | 3.0 ml |
| Polyoxyethylene p-monononylphenyl ether (average degree of polymerization: 10) | 0.3 g | 0.45 g |
| Disodium ethylenediamine-tetraacetate | 0.05 g | 0.08 g |
| Water to make | 1.0 l | 1.0 l |
| pH | 5 to 8 | 5 to 8 |

The processed film obtained at the end of the running test was preserved at 60° C. and at a relative humidity (RH) of 70% for 10 days, and a change of the magenta minimum density ($D_{min}$) due to the preservation was measured.

Further, the fixing bath and the washing bath (1) after the running test were examined with eyes for the presence of a precipitate. The results of observation were rated as follows.

Good . . . No precipitate was observed.

Medium . . . A slight precipitate was observed.

Bad . . . A quantity of a precipitate was observed.

Very bad . . An extremely large amount of a precipitate was observed.

For comparison, the same test was carried out, except for replacing the compound of the present invention as a fixing agent with an equimolar amount of Comparative Compound (A) shown below which is disclosed in U.S. Pat. No. 4,378,424.

Comparative Compound (A):

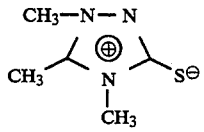

The results obtained are shown in Table 1. It can be seen from the results in Table 1 that use of the compounds according to the present invention reduces thermosrain under a high temperature and high humidity condition and causes no precipitation during running processing. Namely, the method of the present invention produces excellent results in both aspects of image preservability and processing solution stability. On the other hand the use of Comparative Compound (A) provides large thermosrain under a high temperature and high humidity condition, although no precipitation during processing is shown.

TABLE 1

| Fixing Agent | Change in $D_{min}$ due to Preservation | Precipitation in Fixing Bath | Precipitation in Washing Bath (1) | Remark |
|---|---|---|---|---|
| Ammonium thiosulfate | +0.09 | Bad | Very bad | Comparison |
| Compound No. 1 | +0.05 | Good | Good | Invention |
| Compound No. 13 | +0.06 | Good | Good | " |
| Compound No. 16 | +0.05 | Good | Good | " |
| Comparative Compound (A) | +0.12 | Good | Good | Comparison |
| Compound No. 1/ammonium thiosulfate* | +0.06 | Good | Good | Invention |

*In the combination use of Compound No. 1 and ammonium thiosulfate, each was used in a half amount of that in the single use.

EXAMPLE 2

The running test was carried out in the same manner as in Example 1, except for replacing Compound No. 1 as used in Example 1 with each of Compound Nos. 9, 19, 20, 22, 26, 29, 31, 35, and 37. Similarly to Example 1, it was proved that use of the compounds according to the present invention as a fixing agent produced satisfactory results in image preservability under a high temperature and high humidity condition and processing solution stability.

EXAMPLE 3

A color negative film for photography was prepared in the same manner as for Sample No. 1 of JP-A-2-93641 (designated Sample 201).

A running test was carried out using the resulting sample in the same manner as in Example 1. The results obtained are shown in Table 2 below.

It can be seen from Table 2 that use of the compounds according to the present invention reduces thermostain under a high temperature and high humidity condition and causes no precipitation during running processing, proving that the method of the present invention produces excellent results in both aspects of image preservability and processing solution stability.

TABLE 2

| Fixing Agent | Change in $D_{min}$ due to Preservation | Precipitation in Fixing Bath | Precipitation in Washing Bath (1) | Remark |
|---|---|---|---|---|
| Ammonium thiosulfate | +0.06 | Bad | Very bad | Comparison |
| Compound No. 1 | +0.03 | Good | Good | Invention |
| Compound No. 28 | +0.04 | Good | Good | " |
| Compound No. 35 | +0.03 | Good | Good | " |
| Comparative Compound (A) | +0.10 | Good | Good | Comparison |
| Compound No. 1/ammonium thiosulfate* | +0.04 | Good | Good | Invention |

*In the combination use of Compound No. 1 and ammonium thiosulfate, each was used in a half amount of that in the single use.

EXAMPLE 4

A running test was carried out in the same manner as in Example 3, except for replacing Compound No. 1 used as a fixing agent with each of Compound Nos. 9, 29, 31, 37, and 43. Similarly to Example 3, it was proved that use of the compounds according to the present invention as a fixing agent produced satisfactory results in both image preservability under a high temperature and high humidity condition and processing solution stability.

EXAMPLE 5

(1) Preparation of Tabular Grains:

Preparation of Emulsion:

To 1 l of water were added 5 g of potassium bromide, 0.05 g of potassium iodide, 30 g of gelatin, and 2.5 cc of a 5% aqueous solution of a thioether compound $HO(CH_2)_2S(CH_2)_2S(CH_2)_2OH$, and the solution was kept at 73° C. To the solution were simultaneously added an aqueous solution containing 8.33 g of silver nitrate and an aqueous solution containing 5.94 g of potassiumbromide and 0.726 g of potassium iodide over 45 seconds with stirring according to a double jet method. Subsequently, 2.5 g of potassium bromide was added thereto, and an aqueous solution containing 8.33 g of silver nitrate was then added thereto over 26 minutes at an increasing feed rate so that the feed rate at the end of addition was twice the initial one.

After addition of 20 cc of a 25% ammonia solution and 10 cc of a 50% ammonium nitrate ($NH_4NO_3$) solution, the mixture was subjected to physical ripening for 20 minutes, followed by neutralization with 240 cc of 1N sulfuric acid. Then, an aqueous solution containing 153.34 g of silver nitrate and an aqueous solution of potassium bromide were added thereto over 40 minutes according to a controlled double jet method while maintaining a potential at a pAg of 8.2 at an increasing feed rate so that the feed rate at the end of addition was 9 times the initial one. After the addition, 15 cc of a 2N solution of potassium thiocyanate, and 25 cc of a 1% potassium iodide aqueous solution was then added over 30 seconds. The temperature was lowered to 35° C., and soluble salts were removed by a flocculation method. The temperature was raised up to 40° C., and 30 g of gelatin and 2 g of phenol were added thereto. The resulting emulsion was adjusted to a pH of 6.40 and a pAg of 8.10 by addition of caustic soda and potassium bromide.

After raising the temperature to 56° C., 600 mg of a sensitizing dye shown below and 150 mg a stabilizer shown below were added to the emulsion. Ten minutes later, 2.4 mg of sodium thiosulfate pentahydrate, 140 mg of potassium thiocyanate, and 2.1 mg of chloroauric acid were added to the emulsion. After 80 minutes, the emulsion was quenched to solidify.

The thus prepared emulsion comprised tabular grains having an aspect ratio of 3 or more in a proportion of 98% of the total projected area. All the grains having an aspect ratio of 2 or more had an average projected area diameter of 1.4 μm with a standard deviation of 22% and an average thickness of 0.187 μm, giving an average aspect ratio of 7.5.

Sensitizing Dye:

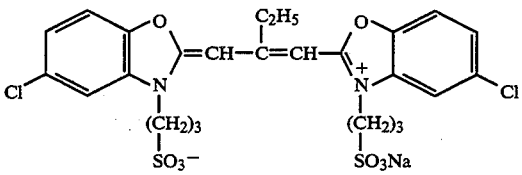

Stabilizer:

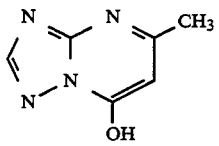

Preparation of Coating Composition:

The following chemicals were added to the above-prepared emulsion in the respective amount shown.

| | |
|---|---|
| Gelatin | Ag/(gelatin + polymer) = 1.10 |
| Water-soluble polyester | 20% based on gelatin |
| Polymer latex (poly(ethyl acrylate/methacrylic acid) = 97/3) | 25.0 g/mol of AgX |
| Hardening agent (1,2-bis-(vinylsulfonylacetamido)-ethane) | 8 mmol per 100 g of gelatin in surface protective layer |
| Phenoxyethanol | 2 g/mol of AgX |
| 2,6-Bis(hydroxyamino)-4-diethyl-amino)-1,3,5-triazine | 80 mg/mol of AgX |
| Sodium polyacrylate (average mol. wt.: 41,000) | 4.0 g/mol of AgX |
| Potassium polystyrenesulfonate (average mol. wt.: 600,000) | 1.0 g/mol of AgX |

Preparation of Light-Sensitive Material (Sample A):

The above-prepared coating composition was coated on both sides of a 175 μm thick transparent polyethylene terephthalate film together with a coating composition for a surface protective layer having the following composition. The double silver spread (total coverage on both sides) was 3.2 g/m².

| Surface Protective Layer Composition: | |
|---|---|
| Gelatin | 1.15 g/m² |
| Polyacrylamide (average mol. wt.: 45,000) | 0.25 g/m² |
| Sodium polyacrylate (average mol. wt. 400,000) | 0.02 g/m² |
| Sodium salt of p-t-octylphenoxydiglyceryl butylsulfonate | 0.02 g/m² |
| Poly(n = 10)oxyethylene cetyl ether | 0.035 g/m² |
| Poly(n = 10)oxyethylene-poly(n = 3)oxyglyceryl p-octylphenoxy ether | 0.01 g/m² |
| 2-Chlorohydroquinone | 0.046 g/m² |
| $C_8H_{17}SO_3K$ | 0.003 g/m² |
| $C_8H_{17}SO_2N(C_3H_7)(CH_2-CH_2O)_4(CH_2)_4SO_3Na$ | 0.001 g/m² |
| $C_8F_{17}SO_2N(C_3H_7)(CH_2CH_2O)_{15}-H$ | 0.003 g/m² |
| Proxel (benzoisothiazoline) | 0.001 g/m² |
| Polymethyl methacrylate (average particle size: 3.5 μm) | 0.025 g/m² |
| Poly(methyl methacrylate/methacrylate) (7:3 by mol; average particle size: 2.5 μm) | 0.020 g/m² |

(2) Preparation of Potato-like Grains:

To 900 cc of water were added 20 g of gelatin, 30 g of potassium bromide, and 3.91 g of potassium iodide, and the solution was kept at 48° C. An aqueous solution of 35 g of silver nitrate was added thereto with stirring over 4 minutes.

An ammoniacal silver nitrate solution (silver nitrate: 165 g) and a potassiumbromide aqueous solution were then added thereto simultaneously over 5 minutes according to a double jet method. After the addition, soluble salts were removed by a flocculation method at 35° C. After the temperature was raised to 40° C., 100 g of gelatin was further added thereto, and the pH was adjusted to 6.7. The resulting emulsion comprised potato-like grains having a mean sphere-equivalent diameter of 0.82 μm and a silver iodide content of 2 mol %. The emulsion was then subjected to gold-sulfur sensitization.

Preparation of Coating Composition:

To the above-prepared emulsion were added 500 mg/mol-Ag of a sodium salt of anhydro-5,5'-dichloro-9-ethyl-3,3'-di(sulfopropyl)oxacarbocyanine hydroxide and 200 mg/mol-Ag of potassium iodide as sensitizing dyes; 4-hydroxy-6-methyl-1,3,3*a*,7-tetraazaindene, 2,6-bis(hydroxyamino)-4-diethylamino-1,3,5-triazine, and nitron as stabilizers; trimethylolpropane as a drying fog inhibitor; a coating aid; and a hardening agent to prepare a coating composition for a light-sensitive emulsion layer.

A gelatin aqueous solution containing polyacrylamide (average mol. wt.: 8,000), sodium polystyrenesulfonate, polymethyl methacrylate fine particles (average particle size: 3.0 μm), polyethylene oxide, a hardening agent, etc. was prepared as a coating composition for a surface protective layer.

Preparation of Light-Sensitive Material (Sample B):

The coating composition for an emulsion layer was coated on both sides of a polyethylene terephthalate film together with the composition for a surface protective layer and dried to obtain a light-sensitive material (B). The double silver spread was 6.4 g/m².

| Preparation of Processing Solutions: | |
|---|---|
| [Concentrated Developing Solution] | |
| Part A: | |
| Potassium hydroxide | 330 g |
| Potassium sulfite | 630 g |
| Sodium sulfite | 240 g |
| Potassium carbonate | 90 g |
| Boric acid | 45 g |
| Diethylene glycol | 180 g |

-continued

| Preparation of Processing Solutions: | |
|---|---|
| Diethylenetriaminepentaacetic acid | 30 g |
| 1-diethylaminoethyl-5-mercaptotetrazole | 0.75 g |
| Hydroquinone | 450 g |
| Water to make | 4125 ml |
| Part B: | |
| Diethylene glycol | 525 g |
| Glacial acetic acid | 102.6 g |
| 5-Nitroindazole | 3.75 g |
| 1-Phenyl-3-pyrazolidone | 34.5 g |
| Water to make | 750 ml |
| Part C: | |
| Glutaraldehyde (50%) | 150 g |
| Potassium metabisulfite | 150 g |
| Potassium bromide | 15 g |
| Water to make | 750 ml |
| [Concentrated Fixing Bath] | |
| Fixing agent (a) or (b): | |
| (a) Ammonium thiosulfate (70% w/v%) | 200 ml |
| (b) Compound of the invention (shown in Table 3) | 0.95 mol |
| Disodium ethylenediaminetetraacetate dihydrate | 0.03 g |
| Sodium thiosulfate pentahydrate | 10 g |
| Sodium sulfite | 20 g |
| Boric acid | 4 g |
| 1-(N,N-Dimethylamino)-ethyl-5-mercaptotetrazole | 1 g |
| Tartaric acid | 3.2 g |
| Glacial acetic acid | 45 g |
| Sodium hydroxide | 15 g |
| Sulfuric acid (36N) | 3.9 g |
| Aluminum sulfate | 10 g |
| Water to make | 400 ml |
| pH | 4.68 |

Parts A, B, and C of the concentrated developing solution were separately charged in three polyethylene containers connected to each other.

The concentrated fixing bath was also charged into a polyethylene container.

Parts A, B, and C of the concentrated developing solution were preserved in the respective container at 50° C. for 3 months before preparation of a developing solution.

Parts A, B, and C and the concentrated fixing bath were charged in a developing tank and a fixing tank, respectively, of an automatic developing machine by means of the respective constant delivery pump fixed to the automatic developing machine to prepare a developing solution I and a fixing bath having the following composition.

| Developing Solution I: | |
|---|---|
| Part A | 55 ml |
| Part B | 10 ml |
| Part C | 10 ml |
| Water | 125 ml |
| pH = 10.50 | |
| Fixing Bath: | |
| Concentrate | 80 ml |
| Water | 120 ml |
| pH = 4.65 | |

Tap water was filled in a washing tank. Four bags of non-woven cloth each containing 50 g of a silver slow-releasing agent comprising $Na_2O/B_2O_5/SiO_2$ (10/65/25) soluble glass containing 1.7% of $Ag_2O$ were sunk to the bottom of the washing tank.

Construction of Automatic Developing Machine:

An automatic developing machine having the following construction was used.

| Processing Step | Tank Volume (l) | Processing Temperature (°C.) | Processing Pass Length (mm) | Processing Time (1) (sec) | Processing Time (2) (sec) |
|---|---|---|---|---|---|
| Development | 15 | 35 (processing (1)) 32 (processing (2)) | 613 | 13.3 | 24.5 |
| | | (liquid surface area/tank volume = 35 $cm^2/l$) | | | |
| Fixing | 15 | 32 | 541 | 11.7 | 21.6 |
| Washing | 13 | 17 (running water) | 305 | 5.7 | 10.5 |
| Squeezing | | | | 6.6 | 12.2 |
| Drying | | 58 | 368 | 8.0 | 14.7 |
| Total | | | 1827 | 45.3 | 83.6 |

Processing:

Each of Samples A and B was exposed to X-ray to 50% blackening and processed using the above-described automatic developing machine and processing solutions for the prescribed processing time. The developer and the fixing bath were replenished at a rate of 45 ml and 30 ml, respectively, per a unit size of 10×12 (inch) in each of processings (1) and (2).

Washing water was supplied through an electromagnetic valve opened at a period synchronous with processing of the light-sensitive material at a flow rate of 5 l/min in processing (2) or 10 l/min in processing (1) (about 1 l/unit size). At the close of the day's work, the electromagnetic valve was automatically opened to drain the washing tank of any remaining water. Crossover rollers between development and fixing and between fixing and washing were automatically cleaned with cleaning water by using a means disclosed in JP-A-62-287252.

After 2,000 films (10×12 in) were processed at the same position (running test), the processed films were preserved at 60° C. and 70% RH for 10 days to examine a change in $D_{min}$ due to the preservation. Further, the fixing bath after the running test was visually observed for the presence of a precipitate. The results of observation were rated based on the same standards as in Example 1.

The same test was carried out using a comparative sample prepared in the same manner as for Sample A or B, except for replacing the compound of the invention with Comparative Compound (A) as used in Example 1.

The results obtained are shown in Table 3.

It can be seen from Table 3 that use of the compounds according to the present invention prevent processed films from suffering thermostain under a high temperature and high humidity condition and causes no precipitation in a fixing bath during running processing, proving that the method of the present invention produces excellent results in both aspects of image preservability and processing solution stability.

TABLE 3

| Fixing Agent | Change in $D_{min}$ due to Preservation: Processing (1) Sample A | Processing (1) Sample B | Processing (2) Sample A | Processing (2) Sample B | Precipitation in Fixing Bath: Processing (1) Sample A | Processing (1) Sample B | Processing (2) Sample A | Processing (2) Sample B | Remark |
|---|---|---|---|---|---|---|---|---|---|
| Ammonium thiosulfate | +0.25 | +0.25 | +0.20 | +0.20 | Medium to bad | Medium to bad | Medium to bad | Medium to bad | Comparison |
| Compound No. 1 | +0.07 | +0.07 | +0.06 | +0.06 | Good | Good | Good | Good | Invention |
| Compound No. 13 | +0.08 | +0.07 | +0.07 | +0.06 | Good | Good | Good | Good | " |
| Compound No. 16 | +0.08 | +0.08 | +0.07 | +0.07 | Good | Good | Good | Good | " |
| Comparative Compound (A) | +0.30 | +0.29 | +0.25 | +0.24 | Good | Good | Good | Good | Comparison |
| Compound No. 1/ammonium thiosulfate* | +0.08 | +0.09 | +0.07 | +0.08 | Good | Good | Good | Good | Invention |

*In the combination use of Compound No. 1 and ammonium thiosulfate, each was used in a half amount of that in the single use.

EXAMPLE 6

A running test was carried out in the same manner as in Example 5, except for replacing Compound No. 1 as used in Example 5 with each of Compound Nos. 19, 20, 26, 35, and 37. As a result, satisfactory results similarly to Example 5 were obtained by using the compounds of the present invention.

EXAMPLE 7

Preparation of Light-Sensitive Emulsion:

A silver nitrate aqueous solution and a mixed aqueous solution of potassium iodide and potassium bromide were simultaneously added to a gelatin aqueous solution kept at 50° C. in the presence of $4\times10^{-7}$ mol/mol-Ag of hexachloroiridate (III) potassium and ammonia over 60 minutes while maintaining a pAg at 7.8 to prepare a cubic mono-dispersed emulsion having a mean grain size of 0.28 μm and an average silver iodide content of 0.3 mol %. After removing soluble salts by a flocculation method, 40 g/mol-Ag of inert gelatin was added to the emulsion. While keeping the emulsion at 50° C., 5,5'-dichloro-9-ethyl-3,3'-bis(3-sulfopropyl)oxacarbocyanine as a sensitizing dye and $10^{-3}$ mol/mol-Ag of a potassium iodide solution were added thereto. After allowing the emulsion to stand for 15 minutes, the temperature was decreased.

Coating of Light-Sensitive Emulsion Layer:

The above prepared emulsion was re-melted, and $7.1\times10^{-5}$ mol/mol-Ag of a hydrazine derivative shown below was added thereto at 40° C.

Hydrazine Derivative:

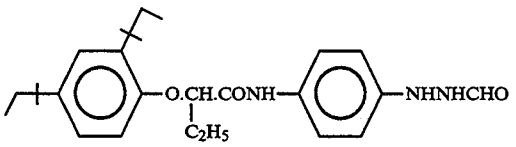

Further, 5-methylbenzotriazole, 4-hydroxy-1,3,3*a*,7-tetraazaindene, 3.5 mg/m² of Compounds (a) shown below, 15.0 mg/m² of Compound (b) shown below, 30%, based on gelatin, of polyethyl acrylate, and 2.0%, based on gelatin, of Compound (c) shown below as a gelatin hardening agent were added thereto. The resulting coating composition was coated on a 150 μm thick polyethylene terephthalate film having a 0.5 μm thick subbing layer comprising a vinylidene chloride copolymer to a silver coverage of 3.4 g/m² and dried to form an emulsion layer.

Compound (a):

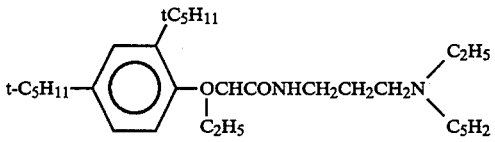

Compound (b):

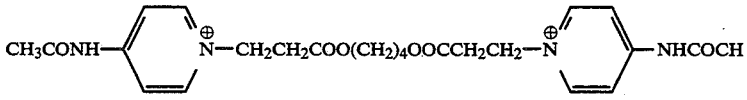

Compound (c):

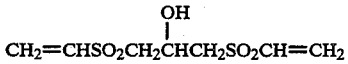

Coating of Protective Layer:

A composition comprising 1.5 g/m² of gelatin, 0.3 g/m² of polymethyl methacrylate particles (mean particle size: 2.5 μm), 0.3 g-Ag/m² of silver chloride fine grains prepared by an ordinary manner (mean grain size: 0.08 μm), and surface active agents shown below was coated on the emulsion layer and dried to form a protective layer.

Surface Active Agents:

-continued

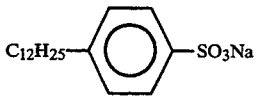

37 mg/m²

$CH_2COOC_6H_{13}$
|
$CHCOOC_6H_{13}$
|
$SO_3Na$ 37 mg/m²

$C_8F_{17}SO_2NCH_2COOK$
|
$C_3H_7$ 2.5 mg/m²

The resulting sample was cut to a size of 50.8 cm×61.0 cm, exposed to light of a tungsten lamp (3200° K.) to 50% blackening, and processed according to the following schedule to obtain 200 processed films.

| Step | Time (sec) | Temp. (°C.) | Rate of Replenishment (ml/m²) |
|---|---|---|---|
| Development | 30 | 34 | 240 |
| Fixing | 30 | 34 | 390 |
| Washing | 30 | 20 | 2000 |

| Developing Solution: | |
|---|---|
| (Running solution = replenisher) | |
| Hydroquinone | 50.0 g |
| N-Methyl-p-aminophenol | 0.3 g |
| Sodium hydroxide | 18.0 g |
| Boric acid | 20.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)benzenesulfonate | 0.2 g |
| 6-Dimethylamino-1-hexanol | 4.0 g |
| Sodium p-toluenesulfonate | 15.0 g |
| 5-Sulfosalicylic acid | 30.0 g |
| Water to make | 1 l |
| pH (adjusted with potassium hydroxide) | 11.7 |
| Fixing Bath: | |
| (Running solution = replenisher) | |
| Fixing agent (a) or (b): | |
| (a) Ammonium thiosulfate | 190.0 g |
| (b) Compound of the invention (Shown in Table 4) | 1 mol |
| Sodium sulfite | 22.0 g |
| Disodium ethylenediaminetetraacetate | 0.1 g |
| Tartaric acid | 3.0 g |
| Aqueous ammonia (27%) | 10.0 g |
| Acetic acid (90%) | 30.0 g |
| Aluminum sulfate (27%) | 35.0 g |
| Water to make | 1 l |
| pH (adjusted with sodium hydroxide) | 4.8 |

The fixing bath after the continuosu processing was visually observed for the presence of any precipitate, and the results were rated on the same standards as in Example 2. Further, the processed film obtained at the end of the continuous processing was preserved at 60° C. and 70% RH for 10 days, and a change in $D_{min}$ due to the preservation was measured.

For comparison, the same test was carried out using a sample prepared in the same manner as described above, except for replacing the compound of the present invention with an equimolar amount of Comparative Compound (A) as used in Example 1.

The results obtained are shown in Table 4.

As can be seen from the results in Table 4, use of the compounds according to the present invention prevent processed films from suffering thermostain under a high temperature and high humidity condition and causes no precipitation during running processing. Namely, the method of the present invention produces excellent results in both aspects of image preservability and processing solution stability.

TABLE 4

| Fixing Agent | Change in $D_{min}$ due to Preservation | Precipitation in Fixing Bath | Remark |
|---|---|---|---|
| Ammonium thiosulfate | +0.22 | Medium to bad | Comparison |
| Compound No. 1 | +0.07 | Good | Invention |
| Compound No. 19 | +0.08 | Good | " |
| Compound No. 20 | +0.09 | Good | " |
| Comparative Compound (A) | +0.28 | Good | Comparison |
| Compound No. 1/ ammonium thiosulfate* | +0.09 | Good | Invention |

*In the combination use of Compound No. 1 and ammonium thiosulfate, each was used in a half amount of that in the single use.

EXAMPLE 8

The same test as in Example 7 was carried out, except for replacing Compound No. 1 as used in Example 7 with each of Compound Nos. 43, 53, 60, and 61. As a result, satisfactory results similarly to Example 7 were obtained by using the compounds of the present invention.

EXAMPLE 9

Silver halide grains were formed by a double jet method. The grains were subjected to physical ripening, desalting, and chemical ripening to obtain a silver chloroiodobromide emulsion having a bromide content of 30 mol % and an iodide content of 0.1 mol %. The silver halide grains of the emulsion had a mean grain size of 0.3 μm. The emulsion contained 0.6 mol of silver halide per kilogram.

A 1 kg aliquot of the resulting emulsion was remelted at 40° C., and a methanol solution of a sensitizing dye and then a sodium bromide aqueous solution were added thereto in prescribed amounts. To the emulsion were further added 25 ml of a 1.0% methanol solution of disodium 4,4'-bis[4,6-di(benzothiazolyl-2-thio]-pyrimidin-2-ylamino]stilbene-2,2'-disulfonate, 30 ml of a 1.0% aqueous solution of sodium 1-hydroxy-3,5-dichlorotriazine, and 40 ml of a 1.0% aqueous solution of sodium dodecylbenzenesulfonate in this order, followed by stirring.

The resulting finished emulsion was coated on a cellulose triacetate film to a dry thickness of 5 μm to prepare a light-sensitive material sample.

The sample was wedgewise exposed to light through a dark red filter ("SC-66" produced by Fuji Photo Film Co., Ltd.) by using a sensitometer equipped with a light source having a color temperature of 2666° K. The exposed sample was continuously processed according to the following schedule so that the amount of replenisher was 3 times the tank volume of developer.

| Step | Time (sec) | Temp. (°C.) | Rate of Replenishment (ml/m²) | Volume of Tank (l) |
|---|---|---|---|---|
| Development | 20 | 38 | 320 | 18 |
| Fixing | 20 | 38 | 320 | 18 |
| Washing | 20 | 20 | 20000 | 18 |

-continued

| | |
|---|---|
| Developing Solution: | |
| (Running Solution = replenisher) | |
| Metol | 0.31 g |
| Anhydrous sodium sulfite | 39.6 g |
| Hydroquinone | 6.0 g |
| Anhydrous sodium carbonate | 18.7 g |
| Potassium bromide | 0.86 g |
| Citric acid | 0.68 g |
| Potassium metabisulfite | 1.5 g |
| Water to make | 1 l |
| Fixing Bath: | |
| (Running solution = replenisher) | |
| Fixing agent (a) or (b): | |
| (a) Ammonium thiosulfate | 200.0 ml |
| (b) Compound of the invention (Shown in Table 5) | 1 mol |
| Sodium hydrogensulfite | 12.0 g |
| Disodium ethylenediaminetetraacetate | 0.1 g |
| Tartaric acid | 3.0 g |
| Aqueous ammonia (27%) | 7.0 g |
| Acetic acid (90%) | 20.0 g |
| Aluminum sulfate (27%) | 35.0 g |
| Water to make | 1 l |
| pH (adjusted with sodium hydroxide) | 4.2 |

After the continuous processing, the fixing bath was visually observed for the presence of any precipitate, and the results were rated on the same standards as in Example 1. Further, the processed sample obtained at the end of the continuous processing was preserved at 60° C. and 70% RH for 10 days, and a change in $D_{min}$ was measured. Density of the processed sample was measured with a P type densitometer produced by Fuji Photo Film Co., Ltd.

For comparison, the same test was carried out on a sample prepared in the same manner as described above, except for replacing the compound of the present invention with an equimolar amount of Comparative Compound (A) as used in Example 1.

The results obtained are shown in Table 5 below.

As is apparent from Table 5, use of the compounds according to the present invention prevent processed films from suffering thermostain under a high temperature and high humidity condition and causes no precipitation during running processing. Namely, the method of the present invention produces excellent results in both aspects of image preservability and processing solution stability.

TABLE 5

| Fixing Agent | Change in $D_{min}$ due to Preservation | Precipitation in Fixing Bath | Remark |
|---|---|---|---|
| Ammonium thiosulfate | +0.24 | Medium to bad | Comparison |
| Compound No. 1 | +0.07 | Good | Invention |
| Compound No. 13 | +0.06 | Good | " |
| Compound No. 16 | +0.07 | Good | " |
| Comparative Compound (A) | +0.29 | Good | Comparison |
| Compound No. 1/ ammonium thio-sulfate* | +0.07 | Good | Invention |

*In the combination use of Compound No. 1 and ammonium thiosulfate, each was used in a half amount of that in the single use.

EXAMPLE 10

Preparation of Emulsion:

To 1 l of water were added 30 g of gelatin and 6 g of potassium bromide, and the resulting gelatin solution was kept at 60° C. To the gelatin solution were simultaneously added an aqueous solution of 5 g of silver nitrate and a potassium bromide aqueous solution containing 0.15 g of potassium iodide with stirring over 1 minute according to a double jet method. Further, an aqueous solution of 145 g of silver nitrate and a potassium bromide aqueous solution containing 4.2 g of potassium iodide were added thereto according to a double jet method at such an increasing feed rate that the feed rate at the end of addition was 5 times the initial one. After completion of the addition, soluble salts were removed at 35° C. by a flocculation method. The temperature was raised to 40° C., and 75 g of gelatin was additionally supplied, followed by pH adjustment to 6.7. The resulting emulsion comprised tabular grains having a projected area diameter of 0.98 μm, an average thickness of 0.138 μm, and a silver iodide content of 3 mol %. The emulsion was subjected to gold-sulfur sensitization.

Preparation of Coating Composition:

To the above-prepared emulsion were added 500 mg/mol-Ag of a sodium salt of anhydro-5,5'-dichloro-9-ethyl-3,3'-di(sulfopropyl)oxacarbocyanine hydroxide and 200 mg/mol-Ag of potassium iodide as sensitizing dyes; 4-hydroxy-6-methyl-1,3,3*a*,7-tetraazaindene, 2,6-bis(hydroxyamino)-4-diethylamino-1,3,5-triazine, and nitron as stabilizers; trimethylolpropane as a drying fog inhibitor; a coating aid; and a hardening agent to prepare a coating composition for a light-sensitive emulsion layer.

Separately, a gelatin aqueous solution containing polyacrylamide ( average mol. wt.: 8,000 ), sodium polystyrenesulfonate, polymethyl methacrylate fine particles (average particle size: 3.0 μm), polyethylene oxide, a hardening agent, etc. was prepared as a coating composition for a surface protective layer.

Preparation of Light-Sensitive Material:

The coating composition for an emulsion layer was coated on both sides of a polyethylene terephthalate film together with the composition for a surface protective layer and dried to obtain a light-sensitive material having a single silver spread of 2 g/m$^2$. The resulting sample had a degree of swelling of 180%.

The sample was exposed to X-ray to 50% blackening and processed according to the following schedule.

| Step | Time (sec) | Temp. (°C.) | Rate of Replenishment (ml/10 × 12 in.) | Volume of Tank (l) |
|---|---|---|---|---|
| Development | 13.7 | 35 | 20 (+10 ml of diluent) | 15 |
| Fixing | 12.5 | 32 | 10 (+30 ml of diluent) | 15 |
| Washing | 6.2 | 20 | 500 | 10 |
| Squeeze Roller Cleaning | | | | 0.2 |

| | Running Solution | Replenisher |
|---|---|---|
| Developing Solution: | | |
| Potassium hydroxide | 24 g | 60 g |
| Sodium sulfite | 40 g | 100 g |
| Potassium sulfite | 50 g | 125 g |
| Diethylenetriaminepentaacetic acid | 2.4 g | 6 g |
| Boric acid | 10 g | 25 g |
| Hydroquinone | 35 g | 87.5 g |
| Diethylene glycol | 11.2 g | 28 g |
| 4-Hydroxymethyl-4-methyl-1-phenyl-3-pyrazolidone | 2.5 g | 6.25 g |
| 5-Methylbenzotriazole | 0.06 g | 0.15 g |
| pH | 10.05 | 11.00 |
| Fixing Bath: | | |
| Fixing agent (a) or (b): | | |
| (a) Ammonium thiosulfate | 140 g | 560 g |

-continued

| | | |
|---|---|---|
| (b) Compound of the invention (Shown in Table 6) | 1 mol | 4 mol |
| Sodium sulfite | 15 g | 60 g |
| Disodium ethylenediamine-tetraacetate dihydrate | 0.025 g | 0.1 g |
| Sodium hydroxide | 6 g | 24 g |
| pH | 5.5 | 5.10 |
| Washing Water: | | |
| Disodium ethylenediamine-tetraacetate dihydrate | 0.5 g | 0.5 g |

Processing was continued at a rate of 50 films (10×12 in.) per day (rate of development of a film: 40%) until the cumulative quantity of the replenisher for the fixing bath reached 3 times the tank volume.

The developing solution was kept circulated for agitation at a rate of 20 l/min while working and at 6 l/min while at a stand-by.

After the continuous processing, the fixing bath was visually observed for the presence of any precipitate, and the results were rated on the same standards as in Example 1. Further, the processed sample was preserved at 60° C. and 70% RH for 10 days, and a change in $D_{min}$ was measured.

For comparison, the same test was carried out on a sample prepared in the same manner as described above, except for replacing the compound of the present invention with an equimolar amount of Comparative Compound (A) as used in Example 1.

The results obtained are shown in Table 6 below.

As is apparent from Table 6, use of the compounds according to the present invention prevent processed films from suffering thermostain under a high temperature and high humidity condition and causes no precipitation during running processing.

TABLE 6

| Fixing Agent | Change in $D_{min}$ due to Preservation | Precipitation in Fixing Bath | Remark |
|---|---|---|---|
| Ammonium thiosulfate | +0.24 | Medium to bad | Comparison |
| Compound No. 1 | +0.06 | Good | Invention |
| Compound No. 13 | +0.07 | Good | " |
| Compound No. 16 | +0.07 | Good | " |
| Comparative Compound (A) | +0.31 | Good | Comparison |
| Compound No. 1/ ammonium thiosulfate* | +0.08 | Good | Invention |

*In the combination use of Compound No. 1 and ammonium thiosulfate, each was used in a half amount of that in the single use.

EXAMPLE 11

A running test was carried out in the same manner as in Example 10, except for replacing Compound No. 1 as used in Example 10 with each of Compound Nos. 3, 5, 7, 9, and 14. As a result, satisfactory results similarly to Example 10 were obtained by using the compounds of the present invention.

EXAMPLE 12

A color reversal film was prepared in the same manner as for Sample 101 of Example 1 of JP-A-2-854, and the processing procedures described therein were followed, except for replacing sodium thiosulfate as used in the fixing bath with the compound of the present invention. As a result, satisfactory results were obtained similarly to the foregoing examples of the present invention.

As described and demonstrated above, use of the compounds according to the present invention provides a method for processing a silver halide photographic material which is excellent in both image preservability of processed light-sensitive materials and stability of a fixing bath and succeeding baths. According to the method of the invention, the processing solutions are prevented from forming a precipitate during running processing. In addition, light-sensitive materials processed by the method of the invention are prevented from suffering from stain under a high temperature and high humidity condition with time.

While the invention has been described in detail and with reference to specific examples thereof, it will be apparent to one skilled in the art that various changes and modifications can be made therein without departing from the spirit and scope thereof.

What is claimed is:

1. A method for processing a silver halide photographic material comprising a support having thereon at least one light-sensitive silver halide emulsion layer, which comprises the steps of:

(a) image-wise exposing the silver halide photographic material;

(b) developing the image-wise exposed silver halide photographic material; and (c) desilvering the developed material, said desilvering comprising fixing using a fixing bath containing a fixing agent, wherein said fixing agent is at least one meso-ionic compound represented by formula (I):

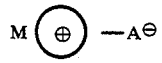

(I)

wherein M represents a 5- or 6-membered heterocyclic ring where the ring members of the heterocyclic ring are selected from the group consisting of a carbon atom, a nitrogen atom, an oxygen atom, a sulfur atom and a selenium atom; and $A^{\theta}$ represents $—O^{\theta}$ or $—S^{\theta}$; provided that meso-ionic 1,2,4-triazolium-3-thiolate compounds are excluded from formula (I) and thiosulfate is excluded from the fixing bath; and wherein said meso-ionic compound is present in the fixing bath in a concentration of from 0.1 to 3 mol/l.

2. A method for processing a silver halide photographic material as in claim 1, wherein $A^{\theta}$ represents $—S^{\theta}$.

3. A method for processing a silver halide photographic material as in claim 1, wherein said compound represented by formula (I) is a compound represented by formula (II):

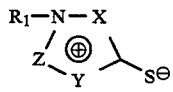

(II)

wherein X represents N or C-$R_2$; Y represents O, S, N or N-$R_3$; and Z represents N, N-$R_4$ or C-$R_5$; $R_1$, $R_2$, $R_3$, $R_4$, and $R_5$, which may be the same or different, each represents an alkyl group, a cycloalkyl group, an alkenyl group, an alkynyl group, an aralkyl group, an aryl group, a heterocyclic group, an amino group, an acylamino group, a sulfonamido group, a ureido group, a sulfamoylamino group, an acyl group, a thioacyl group, a carbamoyl group, or a thiocarbamoyl group; or $R_2$ and $R_5$ each represents a hydrogen atom; or $R_1$ and $R_2$, $R_1$ and $R_4$, $R_1$ and $R_5$, and $R_3$ and $R_4$, or $R_3$ and $R_5$ may be connected to each other to form a ring; provided that when X is N, Y is not N-$R_3$ and Z is not C-$R_5$.

4. A method for processing a silver halide photographic material as in claim 1, wherein the 5-membered heterocyclic ring represented by M is selected from the group consisting of an imidazolium ring, a pyrazolium ring, an oxazolium ring, an isoxazolium ring, a thiazolium ring, an isothiazolium ring, a 1,3-dithiol ring, a 1,3,4- or 1,2,3-oxadiazolium ring, a 1,3,2-oxathiazolium ring, a 1,2,3-triazolium ring, a 1,3,4-triazolium ring exclusive of its thiolate, a 1,3,4-, 1,2,3- or 1,2,4-thiadiazolium ring, a 1,2,3,4-oxatriazolium ring, a 1,2,3,4-tetrazolium ring, and a 1,2,3,4-thiatriazolium ring.

5. A method for processing a silver halide photographic material as in claim 1, wherein said silver halide photographic material has a halogen composition of AgBrI in which the silver iodide content is at least 2 mol %, and said meso-ionic compound is contained in the fixing bath in a concentration ranging from 0.5 to 2 mol/l.

6. A method for processing a silver halide photographic material as in claim 1, wherein said silver halide photographic material has a halogen composition of AgBr, AgBrCl or a high silver content of at least 80 mol %, and said meso-ionic compound is contained in the fixing bath in a concentration ranging from 0.1 to 1 mol/l.

7. A method for processing silver halide photographic material as in claim 1, wherein said meso-ionic compound is

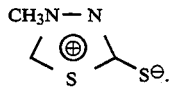

* * * * *